US008373644B2

(12) United States Patent
Koike et al.

(10) Patent No.: US 8,373,644 B2
(45) Date of Patent: Feb. 12, 2013

(54) BACKLIGHT LUMINANCE CONTROL APPARATUS AND VIDEO DISPLAY APPARATUS

(75) Inventors: Akira Koike, Osaka (JP); Kohichi Takaku, Osaka (JP); Yoshinori Kohno, Osaka (JP); Shinichi Nagashima, Osaka (JP); Hideto Yagisawa, Osaka (JP); Kodai Yamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 903 days.

(21) Appl. No.: 12/490,622

(22) Filed: Jun. 24, 2009

(65) Prior Publication Data

US 2010/0073276 A1 Mar. 25, 2010

Related U.S. Application Data

(60) Provisional application No. 61/136,652, filed on Sep. 23, 2008.

(30) Foreign Application Priority Data

Dec. 18, 2008 (JP) ..... 2008-322694

(51) Int. Cl.
*G09G 3/36* (2006.01)

(52) U.S. Cl. ..... 345/102

(58) Field of Classification Search ..... 345/87–104, 345/204–215, 690–699
See application file for complete search history.

(56) References Cited

U.S. PATENT DOCUMENTS 6,559,837 B1 * 5/2003 Lasneski et al. ..... 345/204
6,664,973 B1 * 12/2003 Iwamoto et al. ..... 345/589
7,432,897 B2 * 10/2008 Nishitani et al. ..... 345/87
7,522,135 B2 * 4/2009 Baik ..... 345/88
7,705,814 B2 * 4/2010 Baik et al. ..... 345/88
8,164,564 B2 * 4/2012 Kim et al. ..... 345/102
2001/0033260 A1 * 10/2001 Nishitani et al. ..... 345/87
2003/0222841 A1 * 12/2003 Hirosue ..... 345/89
2004/0257329 A1 * 12/2004 Park et al. ..... 345/102
2005/0052446 A1 * 3/2005 Plut ..... 345/211
2005/0104827 A1 * 5/2005 Baik ..... 345/87
2005/0104838 A1 5/2005 Sasaki
2005/0104840 A1 * 5/2005 Sohn et al. ..... 345/102
2005/0184952 A1 * 8/2005 Konno et al. ..... 345/102
2005/0270265 A1 * 12/2005 Plut ..... 345/102
2005/0270283 A1 * 12/2005 Plut ..... 345/211

(Continued)

FOREIGN PATENT DOCUMENTS

JP 2007-219234 A 8/2007
JP 2007-240858 A 9/2007

(Continued)

*Primary Examiner* — Alexander Eisen
*Assistant Examiner* — Patrick F Marinelli
(74) *Attorney, Agent, or Firm* — Birch, Stewart, Kolasch & Birch, LLP

(57) ABSTRACT

In a video display apparatus, a backlight for illuminating a liquid crystal panel is segmented into a plurality of areas. A frequency distribution processing unit calculates a dark pixel amount from the frequency distribution of the gradation values of pixels in a video image. A backlight control unit calculates a lower limit of luminance in each area included in the backlight so that the lower limit increases as the dark pixel amount becomes smaller. The backlight control unit adjusts the luminance in each area individually according to the gradation values in each portion of the video image, and adjusts the luminance in an area where the luminance is less than the lower limit to the lower limit. The difference in luminance between the areas illuminating dark portions of the video image is decreased, and the occurrence of luminance blur resulting from the difference in luminance between the areas is reduced.

14 Claims, 18 Drawing Sheets

U.S. PATENT DOCUMENTS

| | | | | |
|---|---|---|---|---|
| 2005/0275651 | A1* | 12/2005 | Plut | 345/211 |
| 2006/0238487 | A1* | 10/2006 | Shih | 345/102 |
| 2007/0285379 | A1* | 12/2007 | Jung et al. | 345/102 |
| 2007/0296886 | A1 | 12/2007 | Inada et al. | |
| 2008/0100554 | A1* | 5/2008 | Mori | 345/89 |
| 2008/0111784 | A1 | 5/2008 | Tanaka et al. | |
| 2008/0150884 | A1 | 6/2008 | Ito | |
| 2009/0184916 | A1* | 7/2009 | Miyazaki et al. | 345/102 |
| 2010/0225574 | A1* | 9/2010 | Fujiwara et al. | 345/102 |
| 2011/0025592 | A1* | 2/2011 | Botzas et al. | 345/102 |

FOREIGN PATENT DOCUMENTS

| | | | |
|---|---|---|---|
| JP | 2007-256678 | A | 10/2007 |
| JP | 2008-9415 | A1 | 1/2008 |
| JP | 2009-128608 | A | 6/2009 |
| KR | 2008-0060173 | A | 7/2008 |
| RU | 63 073 | U1 | 5/2007 |
| RU | 2 310 926 | C1 | 11/2007 |
| WO | WO 2005/024765 | A2 | 3/2005 |
| WO | WO 2009/096068 | A1 | 8/2009 |

* cited by examiner

BACKLIGHT LUMINANCE CONTROL APPARATUS AND VIDEO DISPLAY APPARATUS

CROSS-REFERENCE TO RELATED APPLICATION

This Non-provisional application claims priority under 35 U.S.C. §119(e) on U.S. Provisional Application No. 61/136,652 filed on Sep. 23, 2008, and under 35 U.S.C. §119(a) on Patent Application No. 2008-322694 filed in Japan on Dec. 18, 2008, the entire contents of which are hereby incorporated by reference.

BACKGROUND

1. Technical Field

The present invention relates to a video display apparatus constructed using a liquid crystal panel and a backlight, and more specifically relates to a backlight luminance control apparatus which adjusts the quality of a video image by controlling the luminance distribution of the backlight and the video display apparatus.

2. Description of Related Art

Conventionally, liquid crystal displays are widely used as video display apparatuses, such as monitor devices for computers, and television receivers. A liquid crystal display is constructed using a liquid crystal panel and a backlight for illuminating the liquid crystal panel from the back side, and displays a video image by controlling light from the backlight to be transmitted or blocked in each portion on the liquid crystal panel. Although many backlights use fluorescent tubes as their light sources, a backlight using light emitting diodes (LEDs) as the light source has also been developed. Japanese Patent Application Laid-Open No. 2007-219234 discloses a video display apparatus using LEDs as the light source of the backlight.

A backlight using LEDs is constructed by arranging a large number of LEDs in a plane, and placed on the back side of the liquid crystal panel. The backlight is segmented into a plurality of areas which illuminate different positions on the liquid crystal panel, and the video display apparatus is capable of controlling the luminance in each area of the backlight individually. Each area of the backlight includes a plurality of LEDs and illuminates a portion of the liquid crystal panel. A video image displayed by the video display apparatus usually includes a relatively bright portion and a relatively dark portion. A portion of the liquid crystal panel which displays a bright portion of the video image needs to be illuminated by the backlight with high luminance, while the backlight can have lower luminance for a portion of the liquid crystal panel which displays a dark portion of the video image. Thus, by adjusting the luminance in each area of the backlight individually to increase the luminance in an area illuminating a portion of the liquid crystal panel which displays a bright portion of the video image and decrease the luminance in an area illuminating a portion which displays a dark portion, it is possible to reduce the power consumption of the video display apparatus while securing necessary luminance.

SUMMARY

As described above, in a video display apparatus which controls individually the luminance in each area included in the backlight, an area which illuminates a portion of the liquid crystal panel which displays a dark portion of the video image has low luminance, while an area which illuminates a portion of the liquid crystal panel which displays a bright portion of the video image has high luminance. By the way, since the portion illuminated by one area of the backlight has a certain space, there is a case where a single area of the backlight illuminates a video image portion containing both a bright portion and a dark portion. Such an area needs to illuminate the liquid crystal panel at high luminance in order to display the bright portion of the video image. Therefore, a dark portion adjacent to a bright portion of the video image is illuminated at high luminance by the backlight. In other words, there are different types of dark portions even in a single video image: one is a dark portion illuminated at high luminance by the backlight, and the other is a dark portion illuminated at low luminance, and the dark portion illuminated at high luminance is brighter than the dark portion illuminated at low luminance. Hence, on the video image, there occurs a phenomenon where a portion which is darker than a bright portion but brighter than a dark portion appears in the periphery of the bright portion. In this phenomenon, since it looks as if the luminance in the bright portion spreads out to the periphery, the phenomenon will be hereinafter referred to as the "luminance blur".

The luminance blur appears noticeably when a viewer sees a half-tone video image displayed on the video display apparatus from an oblique direction. This is due to the viewing angle characteristics of liquid crystals. In a video image of low luminance, since the viewing angle dependence of liquid crystal is small, the video image is less susceptible to luminance blur. In a half-tone video image, since the influence of the viewing angle is greater, the half-tone video image is susceptible to luminance blur. Since the luminance blur degrades the quality of the video image, the occurrence of luminance blur needs to be reduced in order to improve the quality of a video image displayed by the video display apparatus, especially when displaying a half-tone video image. However, Japanese Patent Application Laid-Open No. 2007-219234 does not mention techniques for reducing the occurrence of luminance blur.

The present invention has been made with the aim of solving the above problems, and it is an object of the invention to provide a backlight luminance control apparatus and a video display apparatus which can reduce the occurrence of luminance blur by reducing the difference in luminance between areas illuminating dark portions of a video image among a plurality of areas included in a backlight.

A luminance control apparatus according to the present invention is a luminance control apparatus for individually controlling luminance in each of a plurality of segmented areas of a planar backlight, which illuminates a video display panel for displaying a video image based on a video signal, to be luminance according to gradation values of the video image displayed in an area of the video display panel illuminated by each area, and characterized by comprising: means for obtaining a frequency distribution of gradation values of pixels included in the video image based on the video signal; means for calculating, from the frequency distribution obtained by the means, a dark pixel amount indicating an amount of pixels whose gradation values are equal to or less than a predetermined first reference value; means for calculating a lower limit of luminance in the areas to a value which decreases monotonously according to the dark pixel amount; and means for adjusting the luminance in an area where the luminance according to the gradation values of the video image is less than the lower limit among a plurality of areas of the backlight to the lower limit.

A video display apparatus according to the present invention is a video display apparatus including a video display panel for displaying a video image based on a video signal, a backlight for illuminating the video display panel by emitting light in a planar manner, and means for individually controlling luminance in each of a plurality of segmented areas of the backlight to be luminance according to gradation values of the video image displayed in an area of the video display panel illuminated by each area, and characterized by comprising: means for obtaining a frequency distribution of gradation values of pixels included in the video image based on the video signal; means for calculating, from the frequency distribution obtained by the means, a dark pixel amount indicating an amount of pixels whose gradation values are equal to or less than a predetermined first reference value; means for calculating a lower limit of luminance in the areas to a value which decreases monotonously according to the dark pixel amount; and means for adjusting the luminance in an area where the luminance according to the gradation values of the video image is less than the lower limit among a plurality of areas of the backlight to the lower limit.

According to the present invention, in the video display apparatus in which the backlight for illuminating the video display panel is segmented into a plurality of areas, the dark pixel amount is calculated from the frequency distribution of the gradation values of the pixels in the video image based on the video signal. The lower limit of luminance in a plurality of areas included in the backlight is calculated so that the smaller the dark pixel amount, the higher the lower limit. The luminance in each area of the backlight is adjusted individually according to the gradation values in each portion of the video image, and the luminance in an area where the luminance according to the gradation values is less than the lower limit is adjusted to the lower limit. Hence, the minimum luminance in a plurality of areas included in the backlight is increased, thereby reducing the difference in luminance between an area which illuminates only a dark portion and an area which illuminates both a bright portion and a dark portion of the video image.

A video display apparatus according to the present invention is characterized by further comprising: means for calculating an average value of the gradation values from the frequency distribution; and means for correcting the lower limit by multiplying the calculated lower limit by a coefficient which increases monotonously according to the average value calculated by the means.

According to the present invention, the video display apparatus calculates an average value of the gradation values from the frequency distribution of the video image, and corrects the lower limit by multiplying the lower limit by the coefficient which decreases as the average value of the gradation values becomes smaller. In a video image which is dark on the whole with a small average value of gradation values, the lower limit of luminance in a plurality of areas included in the backlight is lower, and the luminance in an area illuminating a dark portion of the video image becomes lower, thereby reducing the occurrence of black floating.

A video display apparatus according to the present invention is characterized by further comprising: means for calculating, from the frequency distribution, a bright pixel amount indicating an amount of pixels whose gradation values are equal to or greater than a predetermined second reference value which is greater than the first reference value; and means for correcting the lower limit by multiplying the calculated lower limit by a coefficient which increases monotonously according to the bright pixel amount calculated by the means.

According to the present invention, the bright pixel amount is calculated from the frequency distribution of the video image, and the lower limit of luminance in a plurality of areas included in the backlight is corrected by multiplying the lower limit by the coefficient which increases as the bright pixel amount becomes greater. The coefficient increases as the bright pixel ratio becomes greater, and therefore, when displaying a video image having a high bright pixel ratio and a large amount of bright pixels, the minimum luminance in the areas increases, thereby effectively reducing the occurrence of luminance blur.

A video display apparatus according to the present invention is characterized by further comprising: means for measuring ambient brightness; and means for correcting the lower limit by multiplying the calculated lower limit by a coefficient which increases monotonously according to the ambient brightness measured by the means.

According to the present invention, the video display apparatus measures ambient brightness, and corrects the lower limit of luminance in a plurality of areas included in the backlight by multiplying the lower limit by the coefficient which increases as the measured brightness becomes higher. The coefficient increases as the ambient brightness becomes higher, and therefore, when a video image is displayed under an environment with bight external light, the minimum luminance of the backlight increases, thereby effectively reducing the occurrence of luminance blur while making a decrease in the contrast ratio less noticeable.

A video display apparatus according to the present invention is characterized by further comprising: specifying means for specifying an area where the luminance according to the gradation values of the video image is equal to or greater than the lower limit from a plurality of areas of the backlight; and means for limiting an area whose luminance is to be adjusted to the lower limit among areas where the luminance according to the gradation values of the video image is less than the lower limit to areas located within a predetermined distance from the area specified by the specifying means.

According to the present invention, the video display apparatus limits an area whose luminance is less than the lower limit and is to be adjusted to the lower limit among a plurality of areas included in the backlight to areas located within a predetermined distance from an area where luminance according to the video image is equal to or greater than the lower limit. Since the number of areas where luminance increases is limited, an increase in the power consumption is reduced.

According to the present invention, the difference in luminance between an area illuminating both a bright portion and a dark portion of a video image and an area illuminating only a dark portion among a plurality of areas included in the backlight is reduced. Consequently, the occurrence of luminance blur caused by the difference in luminance between the areas illuminating dark portions of the video image is reduced, thereby improving the quality of the video image displayed by the video display apparatus. Moreover, by determining the lower limit of luminance so that the lower limit increases as the dark pixel amount in the video image becomes smaller, the occurrence of luminance blur is more strongly prevented as the brightness of the video image becomes higher, and thus it is possible to effectively reduce the occurrence of luminance blur. Further, since a dark video image having a high dark pixel ratio is less susceptible to luminance blur, the present invention can provide advantageous effects, such as reducing the power consumption of the video display apparatus within a range of not deteriorating the quality of the video image, by decreasing the lower limit.

The above and further objects and features of the invention will more fully be apparent from the following detailed description with accompanying drawings.

DETAILED DESCRIPTION

The following description will explain in detail the present invention, based on the drawings illustrating some embodiments thereof.

Embodiment 1

Figure 1:
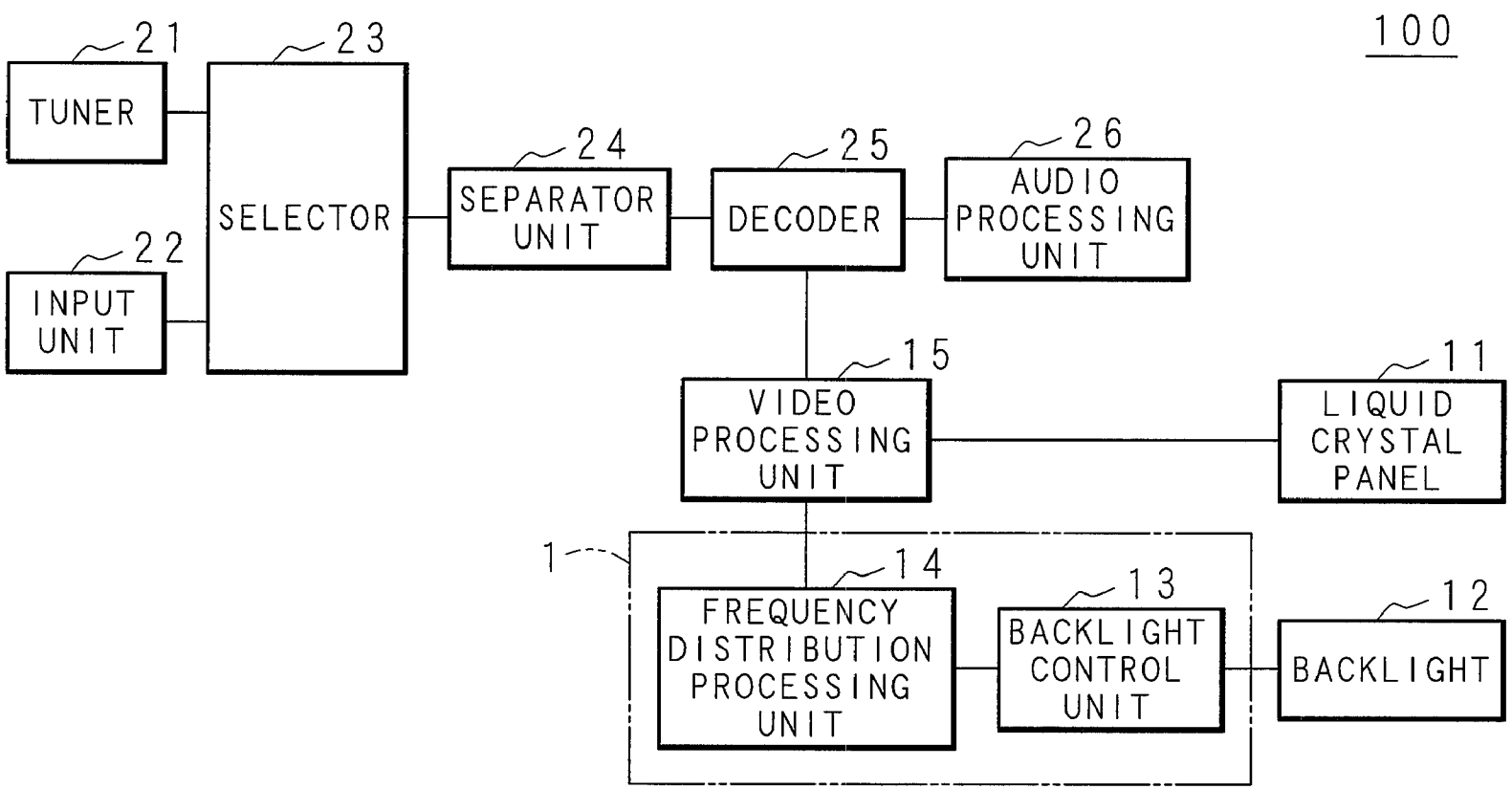
FIG. 1 is a block diagram showing the internal structure of a video display apparatus according to Embodiment 1.

FIG. 1 is a block diagram showing the internal structure of a video display apparatus of Embodiment 1. A video display apparatus 100 of Embodiment 1 comprises a tuner 21, an input unit 22, a selector 23, a separator unit 24, a decoder 25, an audio processing unit 26, a video processing unit 15, a liquid crystal panel 11, a backlight 12, and a luminance control apparatus 1.

The tuner 21 receives broadcast waves with an antenna (not shown), and decodes the received broadcast waves into input data. The input unit 22 obtains input data inputted from an external device (not shown), such as a recorder device or a tuner device. The input data includes video data, audio data, and data for an electronic program guide (EPG), and the video display apparatus 100 of Embodiment 1 displays a video image based on the video data. The video display apparatus 100 can be configured to handle digital data, or analog data, as the input data.

The tuner 21 and the input unit 22 are connected to the selector 23 which selects either the tuner 21 or the input unit 22 to input the input data. The selector 23 selects either the tuner 21 or the input unit 22 as an input source of the input data, according to a need, and obtains the input data from the selected tuner 21 or input unit 22. The separator unit 24 is connected to the selector 23. The separator unit 24 separates the input data inputted from the selector 23 into a plurality of types of data, such as video data, audio data, and data for EPG. The separator unit 24 is connected to the decoder 25, and the decoder 25 decodes various types of data separated from the input data by the separator unit 24. The decoder 25 is connected to the audio processing unit 26 and outputs the audio data after being decoded to the audio processing unit 26. The audio processing unit 26 performs a process for outputting sounds according to the audio data through a speaker (not shown).

The decoder 25 is also connected to the video processing unit 15 and outputs the video data after being decoded to the video processing unit 15. The video processing unit 15 executes a process of generating a video signal for displaying one frame of video image from the video data obtained from the decoder 25. For example, the video processing unit 15 generates a video signal by executing video processing, such as a matrix process for calculating a gradation value of each color, an enhancing process for enhancing a video image, a color adjustment, a tint adjustment, and a white balance adjustment, according to a need. The liquid crystal panel 11 is connected to the video processing unit 15, and the video processing unit 15 outputs the video signal to the liquid crystal panel 11. The liquid crystal panel 11 is a video display panel according to the present invention, and displays a video image based on the video signal.

In addition, a frequency distribution processing unit 14 is connected to the video processing unit 15, and a backlight control unit 13 is connected to the frequency distribution processing unit 14. The frequency distribution processing unit 14 and the backlight control unit 13 are the luminance control apparatus 1 of the present invention. The video processing unit 15 outputs the video signal to the frequency distribution processing unit 14. The frequency distribution processing unit 14 obtains the frequency distribution of gradation values of the pixels contained in the video image, and performs a later-described process of calculating a dark pixel ratio from the obtained frequency distribution. The backlight 12 is connected to the backlight control unit 13. The frequency distribution processing unit 14 outputs the video signal and the dark pixel ratio to the backlight control unit 13, and then the backlight control unit 13 performs a process of controlling the operation of the backlight 12 based on the video signal and the dark pixel ratio.

Figure 2:
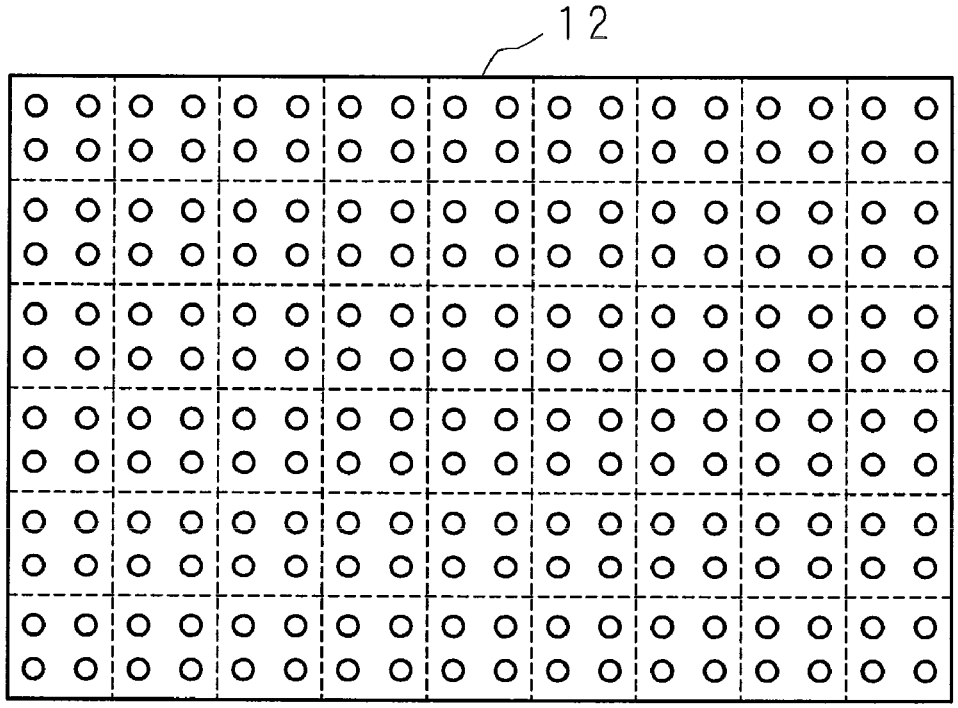
FIG. 2 is a schematic view showing the structure of a backlight.

FIG. 2 is a schematic view showing the structure of the backlight 12. The backlight 12 uses LEDs as a light source and is configured by two-dimensionally arranging a plurality of LEDs in a plane as a whole. In FIG. 2, the LEDs are indicated by circles. The backlight 12 emits light in a planar manner by causing a plurality of two-dimensionally arranged LEDs to emit light. The backlight 12 is segmented into a plurality of areas which illuminate different portions (areas) on the liquid crystal panel 11. In FIG. 2, a boundary between areas in the backlight 12 is indicated by a broken line. As shown in FIG. 2, each area includes a plurality of LEDs. The backlight control unit 13 controls the luminance in each area of the backlight 12 individually based on the gradation values of the respective pixels represented by the video signal so as to be luminance according to the gradation values of the video image displayed in each area of the liquid crystal panel 11. In other words, the backlight 12 comprises a plurality of areas capable of individually controlling the luminance, which are arranged in a plane. The video processing unit 15, the frequency distribution processing unit 14 and the backlight control unit 13 are incorporated into a single video processor.

Figure 3:
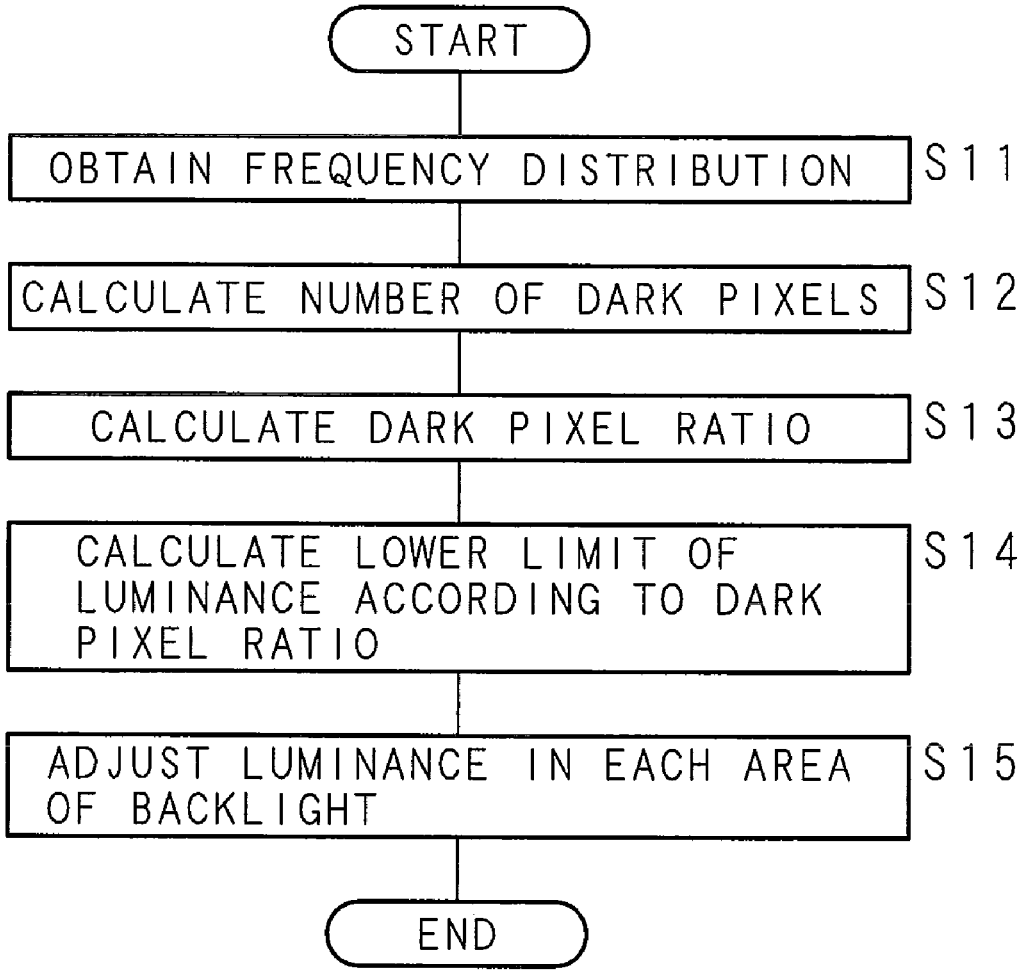
FIG. 3 is a flowchart showing the processing steps carried out by the video display apparatus of Embodiment 1.

Next, the following will explain the details of processes executed by the video display apparatus 100 of Embodiment 1. FIG. 3 is a flowchart showing the processing steps carried out by the video display apparatus 100 of Embodiment 1. When input data is inputted into the video display apparatus 100 of Embodiment 1, the video processing unit 15 generates a video signal and outputs the video signal to the frequency distribution processing unit 14. The frequency distribution processing unit 14 obtains, from the video signal, the frequency distribution of gradation values of the respective pixels included in one frame of video image based on the video signal (S11). The video signal includes information indicating the gradation values of the respective pixels included in the video image by numerical values. One frame of video image based on the video signal corresponds to one screen of video image. In step S11, the frequency distribution processing unit 14 obtains the frequency distribution by counting the pixels having each gradation value. For example, in the case where one frame of video image is composed of 1000×2000 pixels and the gradation value of each pixel is represented by any numerical value between 0 and 255, then the frequency distribution indicates how many pixels having each gradation value between 0 and 255 are in the 1000×2000 pixels.

Figure 4:
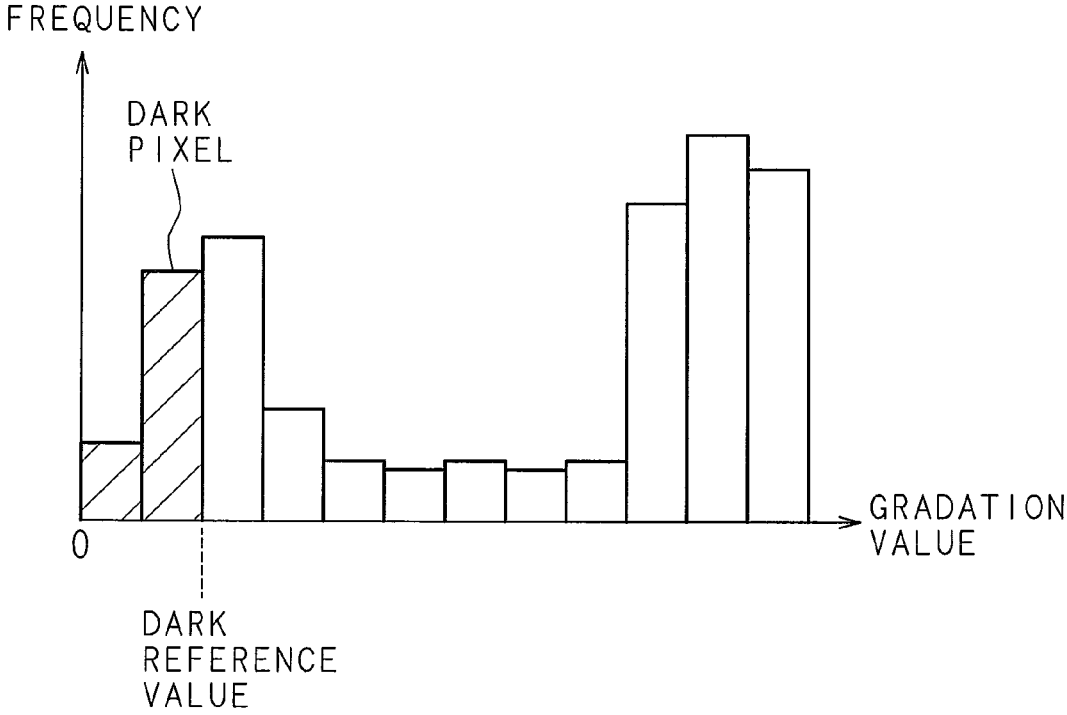
FIG. 4 is a characteristic view showing an example of a histogram that graphically illustrates a frequency distribution.

FIG. 4 is a characteristic view showing an example of a histogram that graphically illustrates the frequency distribution. The horizontal axis in FIG. 4 indicates the gradation values of the pixels included in the video image by numerical values in the range of 0 and 255. The vertical axis in FIG. 4 indicates the frequency corresponding to the number of pixels having each gradation value. The frequency distribution processing unit 14 may obtain the frequency distribution from the whole one frame of video image, or may sample pixels from one frame of video image according to a predetermined rule and obtain the frequency distribution of the gradation values of the sampled pixels. The frequency distribution processing unit 14 may obtain the frequency distribution directly from one frame of video signal, or may obtain a frequency distribution from each field of video signal and add up the frequency distributions of two fields to obtain the frequency distribution of luminance of one frame of video image.

Next, the frequency distribution processing unit 14 calculates, from the obtained frequency distribution, the number of dark pixels representing the number of pixels whose gradation values are equal to or less than a predetermined dark reference value (S12). The dark reference value is a reference value determined in advance for determining a dark pixel that is a pixel having a relatively small gradation value and seen dark in the video image, and is stored in the frequency distribution processing unit 14 in advance. The dark reference value corresponds to a first reference value in the present invention. A value which is greater than the minimum value of the gradation values and seen dark on the screen is used for the dark reference value. FIG. 4 shows a dark reference value. A pixel whose gradation value is equal to or less than the dark reference value is a dark pixel, and the area of a portion where the gradation values are equal to or less than the dark reference value in the histogram shown in FIG. 4 indicates the number of dark pixels. In step S12, the frequency distribution processing unit 14 calculates the number of dark pixels by integrating the portions where the gradation values are equal to or less than the dark reference value in the histogram, or counting the number of pixels whose gradation values are equal to or less than the dark reference value.

Next, the frequency distribution processing unit 14 divides the calculated number of dark pixels by the total number of the pixels in the video image in order to calculate a dark pixel ratio representing the ratio of the dark pixels included in the video image (S13). As the total number of the pixels in the video image, it is possible to count the total number of pixels included in one frame of video image or integrate the histogram each time, or it is possible to use a predetermined value stored in the frequency distribution processing unit 14 in advance. The dark pixel ratio corresponds to a dark pixel amount in the present invention. The frequency distribution processing unit 14 outputs the video signal inputted from the video processing unit 15 and the calculated dark pixel ratio to the backlight control unit 13.

The backlight control unit 13 performs a process of calculating the lower limit of luminance in a plurality of areas included in the backlight 12, according to the inputted dark pixel ratio (S14). The lower limit of luminance calculated in step S14 is a value equal to or greater than the minimum value of luminance realizable by the backlight 12, and is a value defining the lower limit of luminance in each area of the backlight 12 which is actually controlled by the backlight control unit 13. The backlight control unit 13 stores the relation between the dark pixel ratio and the lower limit of luminance in the form of a function or a numerical table, and calculates, in step S14, a lower limit of luminance corresponding to the dark pixel ratio according to the stored contents.

Figure 5:
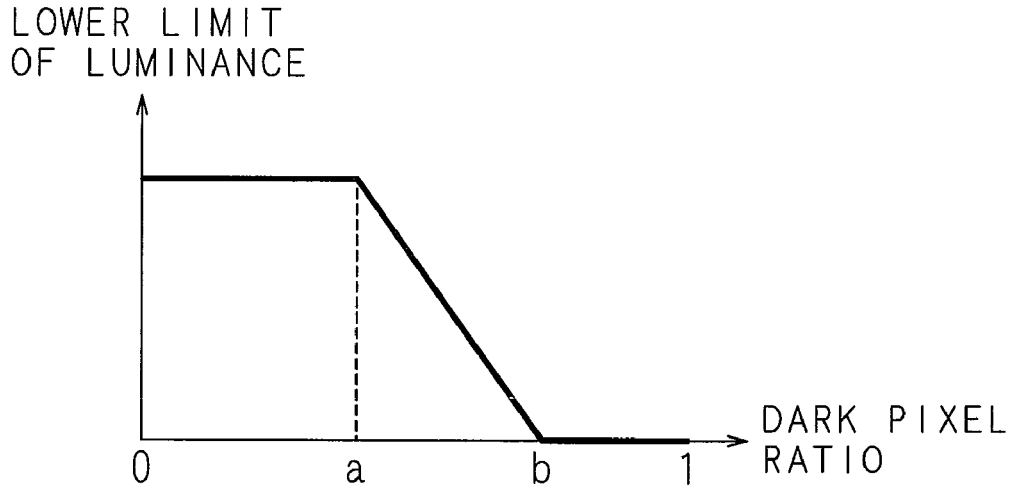
FIG. 5 is a characteristic view showing the relation between the dark pixel ratio and the lower limit of luminance.

FIG. 5 is a characteristic view showing the relation between the dark pixel ratio and the lower limit of luminance. The horizontal axis in FIG. 5 indicates the dark pixel ratio with a minimum value of 0 and a maximum value of 1. The vertical axis in FIG. 5 shows the lower limit of luminance corresponding to each dark pixel ratio. In a state in which the dark pixel ratio takes the maximum value of 1, the lower limit of luminance is a minimum value realizable by the backlight 12. For example, this value is the luminance of 0 at which the LEDs included in an area of the backlight 12 are all turned off. The lower limit of luminance remains at the minimum value until the dark pixel ratio decreases from 1 to a predetermined threshold value b. The lower limit of luminance changes linearly until the dark pixel ratio decreases from the threshold value b and reaches a predetermined threshold value a, so that the smaller the dark pixel ratio, the greater the lower limit of luminance. In a state in which the dark pixel ratio is at the threshold value a, the lower limit of luminance becomes the predetermined maximum value, and the lower limit of luminance remains at the maximum value until the dark pixel ratio decreases from the threshold value a and reaches 0. On the whole, the relation between the dark pixel ratio and the lower limit of luminance is such that the lower limit of luminance decreases monotonously according to the dark pixel ratio and that the lower limit of luminance increases with a decrease in the dark pixel ratio. As the maximum value of the lower limit of luminance, for example, the amount of change in the brightness of the liquid crystal panel 11 when the viewing angle is changed can be used.

Note that the relation between the dark pixel ratio and the lower limit of luminance shown in FIG. 5 is merely one example, and their relation can be different from the one shown in FIG. 5 as long as the lower limit of luminance decreases monotonously with respect to the dark pixel ratio. For instance, the relation between the dark pixel ratio and the lower limit of luminance can be represented by a smooth function. In addition, for example, the lower limit of luminance can take discrete values on the basis of a predetermined value of the dark pixel ratio.

Next, the backlight control unit 13 performs a process of adjusting the luminance in each area of the backlight 12 according to the gradation values of the respective pixels in the video image represented by the inputted video signal so as to adjust the luminance in an area where the luminance is less than the lower limit to the lower limit (S15). The backlight control unit 13 stores the relation between the gradation values of the pixels included in each portion of the video image and the luminance in an area which illuminates a portion (area) of the liquid crystal panel 11 displaying the corresponding portion. For instance, for the maximum value of the pixels included in a portion of the video image illuminated by one area, luminance in the area is determined. In step S15, according to the stored contents, the backlight control unit 13 calculates the luminance in each area according to the gradation values of the respective pixels included in the video image represented by video signal. If the value of the calculated luminance for an area is equal to or greater than the lower limit, the backlight control unit 13 adjusts the luminance in the area to the calculated luminance, while, if the value of the calculated luminance for an area is less than the lower limit, it adjusts the luminance in the area to the lower limit.

Each area of the backlight 12 emits light at luminance controlled by the backlight control unit 13, and the liquid crystal panel 11 adjusts the light transmission amount in a portion corresponding to each pixel in the video image according to the video signal, whereby the video display apparatus 100 displays the video image. With this, the video display apparatus 100 completes the process of displaying one frame of video image. The video display apparatus 100 executes the process of steps S11 to S15 every time it displays one frame of video image.

Figure 6:
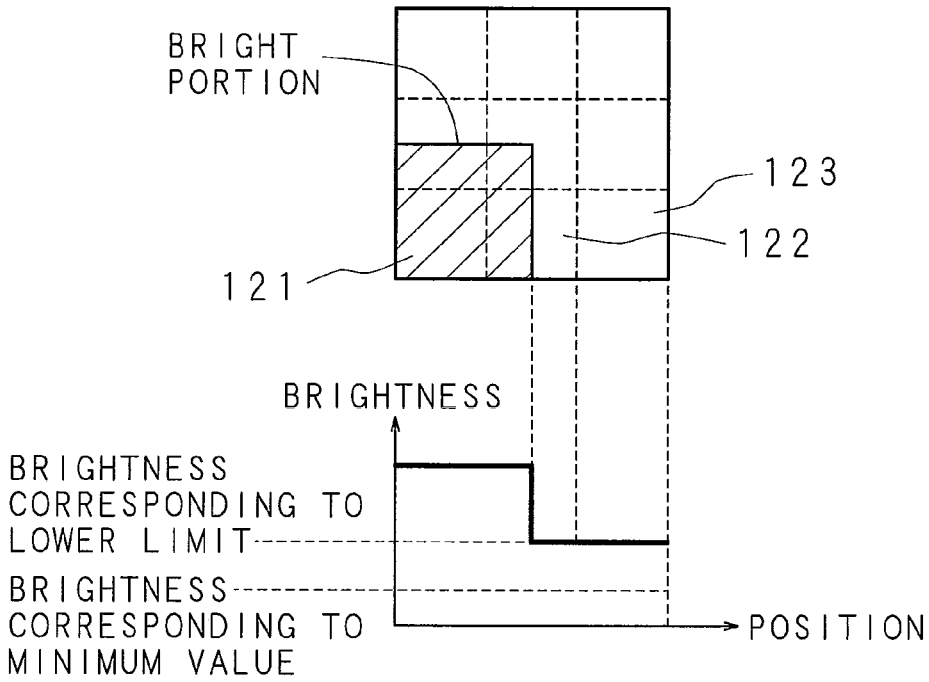
FIG. 6 is a schematic view showing a part of the screen and the brightness distribution on the screen of the video display apparatus of Embodiment 1.

FIG. 6 is a schematic view showing a part of the screen and the brightness distribution on the screen of the video display apparatus 100 of Embodiment 1. The upper side of FIG. 6 shows a part of the screen displaying a video image, and the boundaries between areas of the backlight 12 illuminating the respective portions on the liquid crystal panel 11 displaying the video image are indicated by the broken lines. 121, 122, and 123 in FIG. 6 indicate specific areas. In FIG. 6, a bright portion that is a relatively bright portion in the video image is illustrated, and portions other than the bright portion are dark portions which are darker than the bright portion. Shown on the lower side of FIG. 6 is the brightness distribution at the respective positions on the screen. At a position illuminated by the area 121, since the bright portion of the video image is displayed, the brightness is high. At a position illuminated by the area 122, since a part of the screen shows a bright portion of the video image, the luminance of the area 122 has a value greater than the minimum value realizable by the backlight 12. At a position illuminated by the area 123, since a dark portion of the video image is displayed, the luminance of the area 123 becomes the minimum value according to a prior art and is less than the lower limit of luminance calculated by the present invention.

In other words, with the prior art, the dark portion in the video image illuminated by the area 123 has brightness corresponding to the minimum value of the luminance of the backlight 12. In the present invention, however, the luminance of the area 123 is increased from the luminance of the prior art and adjusted to the lower limit. FIG. 6 shows the example in which the lower limit is adjusted to the same value as the luminance of the area 122. Therefore, the dark portion in the video image illuminated by the area 123 has brightness higher than the prior art brightness in the dark portion, and thus has brightness corresponding to the lower limit representing the luminance of the area 123. In the example shown in FIG. 6, since the area 123 illuminating a dark portion of the video image and the area 122 illuminating a section including both of a bright portion and a dark portion have the same luminance, the dark portions in the video image have the same brightness, and luminance blur does not occur.

As described in detail above, in the video display apparatus 100 of Embodiment 1, a lower limit defining the lower limit of luminance in each area of the backlight 12 is determined, and the luminance in an area where the luminance is less than the lower limit according to the prior art is adjusted to the lower limit. Consequently, in comparison with the prior art, the video display apparatus 100 reduces the difference in luminance between the area illuminating both a bright portion and a dark portion of the video image and an area illuminating only a dark portion. Accordingly, since it is possible to reduce the occurrence of luminance blur in which a dark portion near a bright portion becomes brighter than other dark portions due to the difference in luminance between the respective areas illuminating the dark portions of the video image, the quality of the video image displayed by the video display apparatus 100 is improved.

Further, in Embodiment 1, the video display apparatus 100 determines the lower limit so that the smaller the dark pixel ratio representing the ratio of dark pixels included in the video image, the higher the lower limit of luminance in the area. A dark video image is unsusceptible to luminance blur, but a half-tone video image is susceptible to luminance blur. Therefore, by increasing the lower limit of luminance as the dark pixel ratio becomes smaller, it is possible to more strongly reduce the occurrence of luminance blur as the video image becomes brighter, and it is possible to effectively reduce the occurrence of luminance blur. In a dark video image with a high dark pixel ratio, since luminance blur hardly occurs, it is possible to reduce the power consumption of the video display apparatus 100 within a range of not deteriorating the quality of the video image by decreasing the lower limit of luminance.

Embodiment 2

In Embodiment 1, the lower limit of luminance is calculated according to the dark pixel ratio in a video image. However, if a high lower limit of luminance is set for a video image having low brightness on the whole, black floating occurs in the video image, and the quality of the video image is lowered. Embodiment 2 illustrates a mode in which the lower limit of luminance of the backlight 12 is calculated according to the brightness of the whole video image. Since the internal structure of the video display apparatus 100 according to Embodiment 2 is the same as that in Embodiment 1, the explanation thereof will be omitted.

Figure 7:
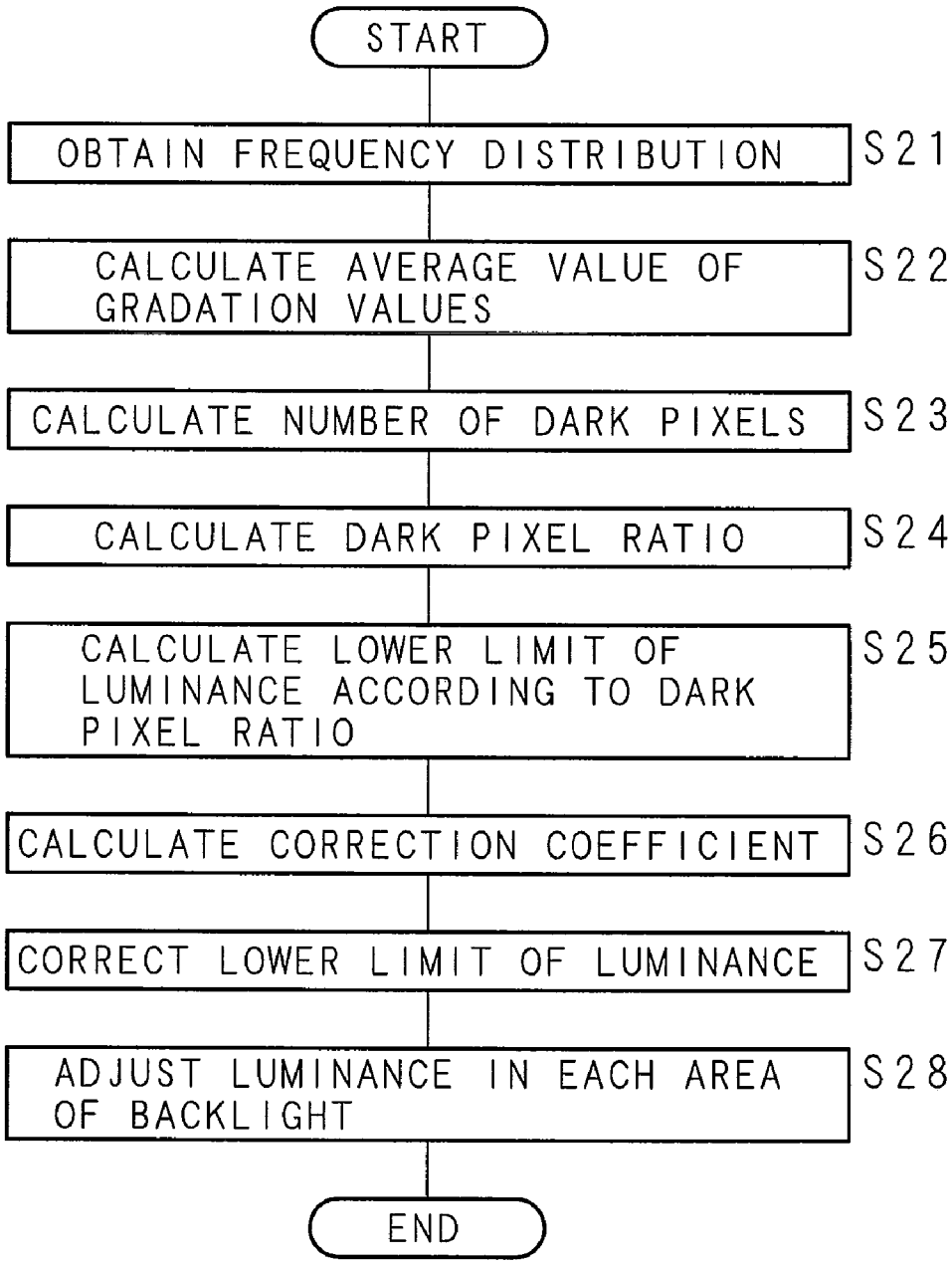
FIG. 7 is a flowchart showing the processing steps carried out by a video display apparatus of Embodiment 2.

FIG. 7 is a flowchart showing the processing steps carried out by the video display apparatus 100 of Embodiment 2. The video processing unit 15 generates a video signal and outputs it to the frequency distribution processing unit 14. The frequency distribution processing unit 14 obtains the frequency distribution of gradation values of the respective pixels included in one frame of video image based on the video signal (S21). Next, the frequency distribution processing unit 14 calculates, from the obtained frequency distribution, the average value of the gradation values in one frame of video image represented by the video signal (S22). For example, based on the frequency distribution, the frequency distribution processing unit 14 calculates the average value of the gradation values of the pixels in the video image by integrating values obtained by multiplying the gradation value by the number of pixels for all the gradation values and then dividing the integrated value by the total number of the pixels. Next, the frequency distribution processing unit 14 calculates the number of dark pixels included in the video image from the obtained frequency distribution (S23), and calculates a dark pixel ratio representing the ratio of the dark pixels in the video image (S24). After completing step S24, the frequency distribution processing unit 14 outputs the video signal, the calculated average value of the gradation values, and the calculated dark pixel ratio to the backlight control unit 13.

The backlight control unit 13 performs a process of calculating the lower limit of luminance in a plurality of areas included in the backlight 12, according to the inputted dark pixel ratio (S25). Next, the backlight control unit 13 calculates a correction coefficient for correcting the lower limit, according to the average value of the gradation values inputted from the frequency distribution processing unit 14 (S26). The backlight control unit 13 stores the relation between the average value of the gradation values and the correction coefficient in the form of a function or a numerical table, and calculates a correction coefficient corresponding to the average value of the gradation values, according to the stored contents in step S26.

Figure 8:
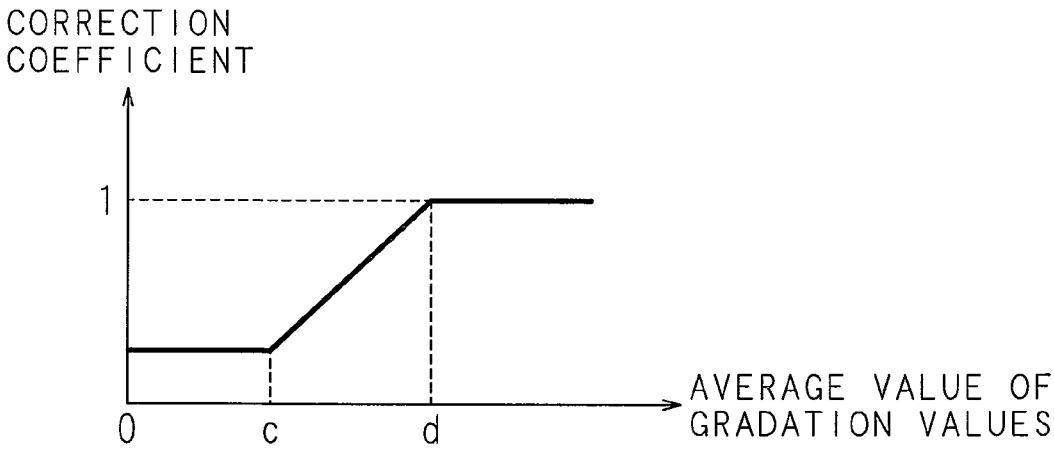
FIG. 8 is a characteristic view showing the relation between the average value of gradation values in a video image and the correction coefficient.

FIG. 8 is a characteristic view showing the relation between the average value of the gradation values in a video image and the correction coefficient. The horizontal axis in FIG. 8 indicates the average value of the gradation values, while the vertical axis indicates the correction coefficient corresponding to the average value of the gradation values. In a state in which the video image is bright on the whole and the average value of the gradation values is high, the correction coefficient takes a maximum value of 1. The correction coefficient remains at the maximum value of 1 until the average value of the gradation values decreases to a predetermined threshold d. The correction coefficient changes linearly until the average value of the gradation values decreases from the threshold d to a predetermined threshold c, so that the lower the average value of the gradation values, the smaller the correction coefficient. In a state in which the average value of the gradation values is at the threshold c, the correction coefficient becomes a predetermined minimum value, and the correction coefficient remains at the minimum value in a state in which the average value of the gradation values is equal to or less than the threshold c. On the whole, the relation between the average value of the gradation values and the correction coefficient is such that the correction coefficient increases monotonously according to the average value of the gradation values, and that the correction coefficient becomes smaller with a decrease in the average value of the gradation values.

The relation between the average value of the gradation values and the correction coefficient shown in FIG. 8 is merely one example, and their relation can be different from the one shown in FIG. 8 as long as the correction coefficient increases monotonously with respect to the average value of the gradation values. For instance, the relation between the average value of the gradation values and the correction coefficient can be represented by a smooth function. In addition, for example, the correction coefficient may take discrete values on the basis of a predetermined average value of the gradation values.

Next, with the use of the calculated correction coefficient, the backlight control unit 13 performs a process of correcting the lower limit of luminance calculated in step S25 (S27). More specifically, the backlight control unit 13 multiplies the lower limit before correction by the correction coefficient in order to calculate a lower limit after correction as shown by the following equation.

$$\text{(lower limit after correction)}=\text{(lower limit before correction)}\times\text{correction coefficient}$$

Next, the backlight control unit 13 performs a process of adjusting the luminance in each area of the backlight 12, according to the gradation values of the respective pixels in the video image represented by the inputted video signal, so as to adjust the luminance in an area where the luminance is less than the lower limit to the lower limit (S28). Each area of the backlight 12 emits light at luminance controlled by the backlight control unit 13, and the liquid crystal panel 11 adjusts the light transmission amount in a portion corresponding to each pixel in the video image, according to the video signal. Accordingly, the video display apparatus 100 displays the video image. With this, the video display apparatus 100 completes the process of displaying one frame of video image. The video display apparatus 100 executes the process of steps S21 to S28 every time it displays one frame of video image.

As described in detail above, in Embodiment 2, the lower limit of luminance in a plurality of areas of the backlight 12 is corrected by multiplying the lower limit of luminance by the correction coefficient which becomes smaller with a decrease in the average value of the gradation values of the pixels. Since the correction coefficient becomes smaller with a decrease in the average value of the gradation values, if the video image has a small average value of gradation values and is dark on the whole, the lower limit of luminance is smaller, and the luminance in an area illuminating a dark portion of the video image is lower. As a result, since the brightness in the dark portion of the video image becomes lower, it is possible to prevent the occurrence of black floating. In the case of a video image which has a large average value of gradation values and is bright on the whole, since the lower limit of luminance in the area is higher, the occurrence of luminance blur is effectively reduced. In the case of a video image which is bright on the whole, even if black floating occurs, it will not be considerably noticeable. Therefore, in Embodiment 2, the occurrence of luminance blur is reduced for a bright video image in which black floating is not noticeable, and the occurrence of black floating is reduced for a video image which is dark on the whole, thereby improving the quality of the video image displayed by the video display apparatus 100.

Embodiment 3

In Embodiment 1, the lower limit of luminance in a plurality of areas of the backlight 12 is set smaller as the dark pixel ratio in the video image increases. By the way, among video images, there is a video image containing a large number of both of dark pixels and bright pixels, but not many pixels having intermediate gradation values. In Embodiment 1, when the dark pixel ratio in the video image is high, luminance blur tends to occur, and further when there are a large number of bright pixels in the video image, luminance blur is noticeable, and the quality of the video image is lowered. Embodiment 3 illustrates a mode in which the lower limit of luminance of the backlight 12 is calculated according to both the amount of dark pixels and the amount of bright pixels. Since the internal structure of the video display apparatus 100 according to Embodiment 3 is the same as that in Embodiment 1, the explanation thereof will be omitted.

Figure 9:
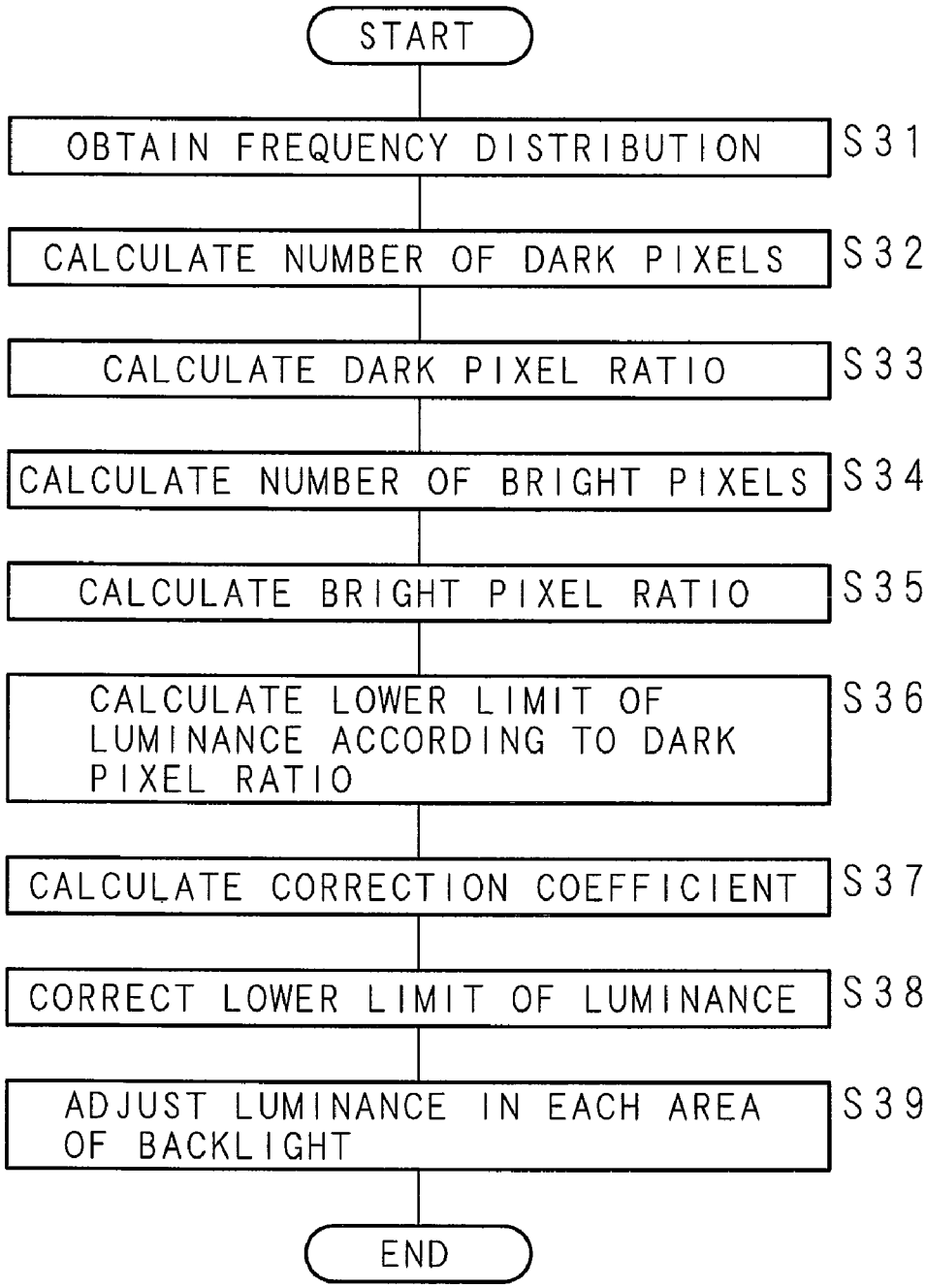
FIG. 9 is a flowchart showing the processing steps carried out by a video display apparatus of Embodiment 3.

FIG. 9 is a flowchart showing the processing steps carried out by the video display apparatus 100 of Embodiment 3. The video processing unit 15 generates a video signal and outputs the video signal to the frequency distribution processing unit 14. The frequency distribution processing unit 14 obtains, from the video signal, the frequency distribution of gradation values of the respective pixels included in one frame of video image based on the video signal (S31). Next, the frequency distribution processing unit 14 calculates, from the obtained frequency distribution, the number of dark pixels included in the video image (S32), and calculates a dark pixel ratio representing the ratio of the dark pixels included in the video image (S33).

Figure 10:
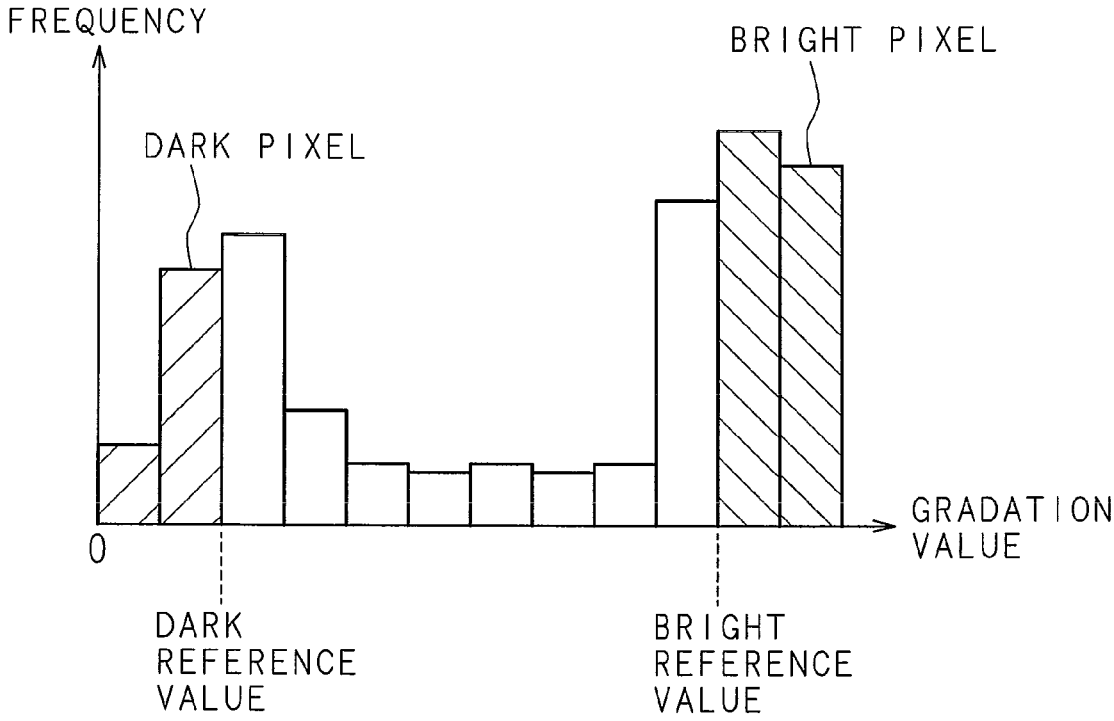
FIG. 10 is a characteristic view showing a histogram to which a bright reference value is added.

Next, the frequency distribution processing unit 14 calculates, from the obtained frequency distribution, the number of bright pixels indicating the number of pixels whose gradation value is equal to or greater than a predetermined bright reference value (S34). The bright reference value is a reference value determined in advance for determining a bright pixel which is a pixel having a relatively large gradation value and seen bright in the video image, and is stored in the frequency distribution processing unit 14 in advance. The bright reference value is greater than the dark reference value, and corresponds to a second reference value in the present invention. As the bright reference value, a value which is greater than the dark reference value but less than the upper limit of gradation values and seen bright on the screen is used. FIG. 10 is a characteristic view showing a histogram to which the bright reference value is added. A pixel whose gradation value is equal to or greater than the bright reference value is a bright pixel, and the area of a portion where the gradation value is equal to or greater than the bright reference value in the histogram shown in FIG. 10 indicates the number of bright pixels. In step S34, the frequency distribution processing unit 14 calculates the number of bright pixels by integrating the portions where the gradation values are equal to or greater than the bright reference value in the histogram, or counting the number of pixels whose gradation values are equal to or greater than the bright reference value.

Next, the frequency distribution processing unit 14 divides the calculated number of bright pixels by the total number of the pixels in the video image in order to calculate a bright pixel ratio representing the ratio of bright pixels included in the video image (S35). The bright pixel ratio corresponds to a bright pixel amount in the present invention. After completing step S35, the frequency distribution processing unit 14 outputs the video signal, the calculated dark pixel ratio and bright pixel ratio to the backlight control unit 13.

The backlight control unit 13 performs a process of calculating the lower limit of luminance in a plurality of areas included in the backlight 12, according to the inputted dark pixel ratio (S36). Next, the backlight control unit 13 calculates a correction coefficient for correcting the lower limit, according to the bright pixel ratio inputted from the frequency distribution processing unit 14 (S37). The backlight control unit 13 stores the relation between the bright pixel ratio and the correction coefficient in the form of a function or a numerical table, and calculates a correction coefficient corresponding to the bright pixel ratio in step S37, according to the stored contents.

Figure 11:
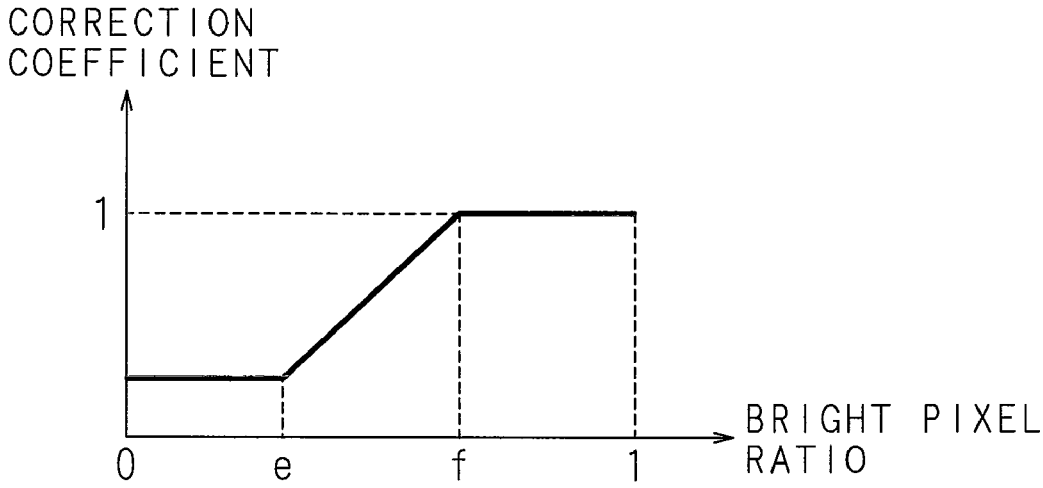
FIG. 11 is a characteristic view showing the relation between the bright pixel ratio and the correction coefficient.

FIG. 11 is a characteristic view showing the relation between the bright pixel ratio and the correction coefficient. The horizontal axis in FIG. 11 indicates the bright pixel ratio, while the vertical axis shows the correction coefficient corresponding to the bright pixel ratio. In a state in which the bright pixel ratio is small, the correction coefficient takes a minimum value. The correction coefficient remains at the minimum value until the bright pixel ratio increases to a predetermined threshold value e. The correction coefficient changes linearly until the bright pixel ratio increases from the threshold value e and reaches a predetermined threshold value f, so that the higher the bright pixel ratio, the higher the correction coefficient. In a state in which the bright pixel ratio is at the threshold value f, the correction coefficient takes a maximum value of 1, and the correction coefficient remains at the maximum value of 1 until the bright pixel ratio increases from the threshold value f to the maximum value of 1. On the whole, the relation between the bright pixel ratio and the correction coefficient is such that the correction coefficient increases monotonously according to the bright pixel ratio, and that the higher the bright pixel ratio, the higher the correction coefficient.

Note that the relation between the bright pixel ratio and the correction coefficient shown in FIG. 11 is merely one example, and their relation can be different from the one shown in FIG. 11 as long as the correction coefficient increases monotonously with respect to the bright pixel ratio. For instance, the relation between the bright pixel ratio and the correction coefficient can be represented by a smooth function. In addition, for example, the correction coefficient can take discrete values on the basis of a predetermined value of the bright pixel ratio.

Next, with the use of the calculated correction coefficient, the backlight control unit 13 performs a process of correcting the lower limit of luminance calculated in step S36 (S38). More specifically, the backlight control unit 13 multiplies the lower limit before correction by the correction coefficient in order to calculate a lower limit after correction as shown by the following equation.

$$\text{(lower limit after correction)}=\text{(lower limit before correction)}\times\text{correction coefficient}$$

Next, the backlight control unit 13 performs a process of adjusting the luminance in each area of the backlight 12 according to the gradation values of the respective pixels in the video image represented by the inputted video signal so as to adjust the luminance in an area where the luminance is less than the lower limit to the lower limit (S39). Each area of the backlight 12 emits light at luminance controlled by the backlight control unit 13, and the liquid crystal panel 11 adjusts the light transmission amount in a portion corresponding to each pixel in the video image, according to the video signal. Accordingly, the video display apparatus 100 displays the video image. With this, the video display apparatus 100 completes the process of displaying one frame of video image. The video display apparatus 100 executes the process of steps S31 to S39 every time it displays one frame of video image.

In Embodiment 3, as described in detail above, the lower limit of luminance in a plurality of areas of the backlight 12 is corrected by multiplying the lower limit of luminance by the correction coefficient which increases as the bright pixel ratio becomes higher. Since the correction coefficient increases with an increase in the bright pixel ratio, when a video image having a high bright pixel ratio and a large number of bright pixels is displayed, the minimum luminance in the area of the backlight 12 is increased, thereby effectively reducing the occurrence of luminance blur. Since luminance blur is noticeable in a video image having a high bright pixel ratio and a large number of bright pixels, if the luminance blur in the video image including a large number of bright pixels is effectively reduced, the quality of the video image displayed by the video display apparatus 100 is improved.

Embodiment 4

Embodiment 4 illustrates a mode in which the lower limit of luminance of the backlight 12, which is determined according to the dark pixel ratio, is corrected according to the brightness and the bright pixel ratio in the whole image. Since the internal structure of the video display apparatus 100 according to Embodiment 4 is the same as that in Embodiment 1, the explanation thereof will be omitted.

Figure 12:
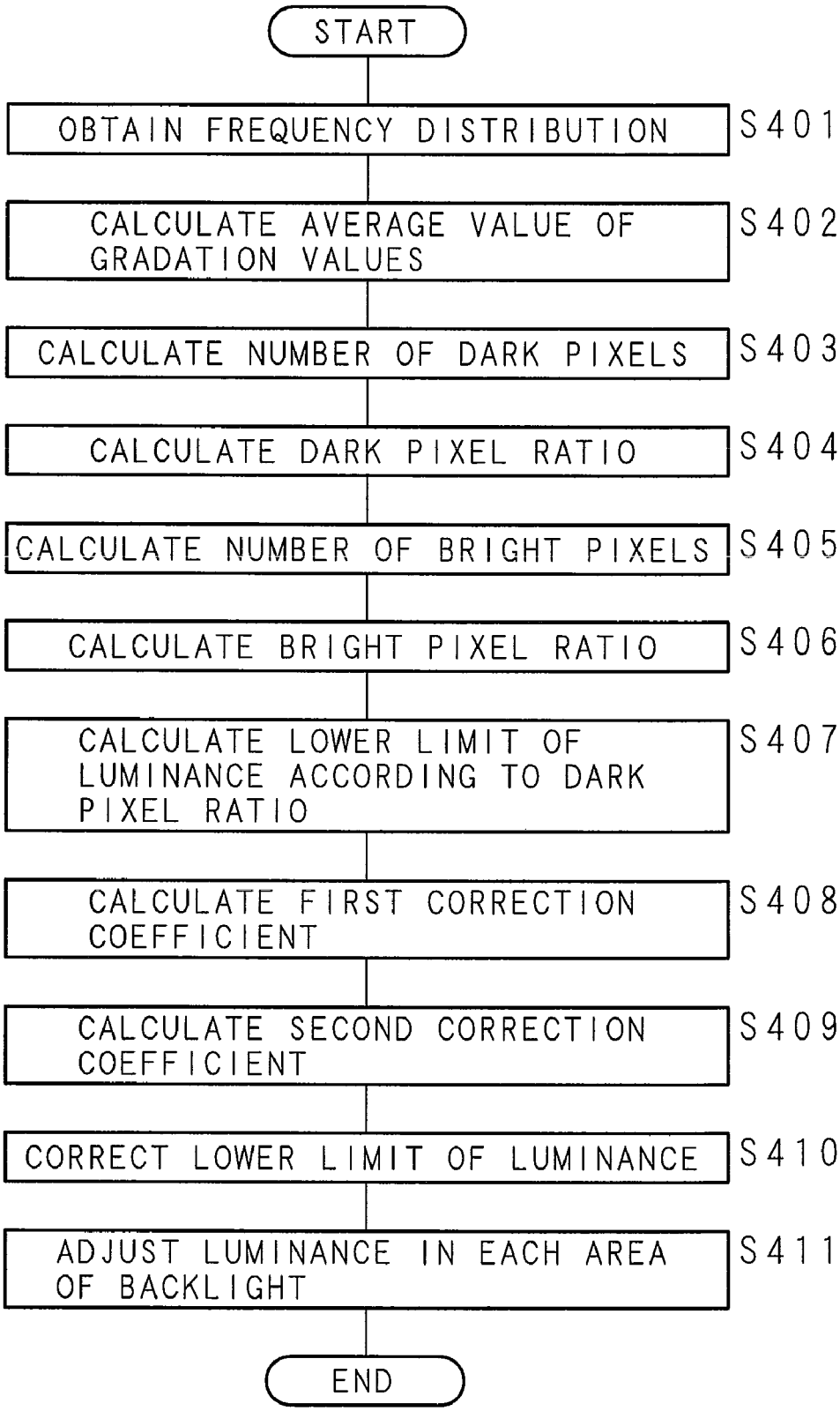
FIG. 12 is a flowchart showing the processing steps carried out by a video display apparatus of Embodiment 4.

FIG. 12 is a flowchart showing the processing steps carried out by the video display apparatus 100 of Embodiment 4. The video processing unit 15 generates a video signal and outputs the video signal to the frequency distribution processing unit 14. The frequency distribution processing unit 14 obtains, from the video signal, the frequency distribution of gradation values of the respective pixels included in one frame of video image based on the video signal (S401). Next, the frequency distribution processing unit 14 calculates, from the obtained frequency distribution, the average value of the gradation values in one frame of video image represented by the video signal (S402). Next, the frequency distribution processing unit 14 calculates the number of dark pixels included in the video image from the obtained frequency distribution (S403), and calculates a dark pixel ratio representing the ratio of the dark pixels included in the video image (S404). Next, the frequency distribution processing unit 14 calculates, from the obtained frequency distribution, the number of bright pixels included in the video image (S405), and calculates a bright pixel ratio representing the ratio of bright pixels included in the video image (S406). After completing step S406, the frequency distribution processing unit 14 outputs the video signal, the calculated average value of the gradation values, dark pixel ratio and bright pixel ratio to the backlight control unit 13.

The backlight control unit 13 performs a process of calculating the lower limit of luminance in a plurality of areas included in the backlight 12, according to the inputted dark pixel ratio (S407). Next, with a method similar to Embodiment 2, the backlight control unit 13 calculates a first correction coefficient for correcting the lower limit, according to the average value of the gradation values inputted from the frequency distribution processing unit 14 (S408). Next, with a method similar to Embodiment 3, the backlight control unit 13 calculates a second correction coefficient for correcting the lower limit, according to the bright pixel ratio inputted from the frequency distribution processing unit 14 (S409).

Next, with the use of the calculated first and second correction coefficients, the backlight control unit 13 performs a process of correcting the lower limit calculated in step S407 (S410). More specifically, the backlight control unit 13 multiplies the lower limit before correction by the first correction coefficient and the second correction coefficient in order to calculate a lower limit after correction as shown by the following equation.

(lower limit after correction)=(lower limit before correction)×(first correction coefficient)×(second correction coefficient)

Next, the backlight control unit 13 performs a process of adjusting the luminance in each area of the backlight 12, according to the gradation values of the respective pixels in the video image represented by the inputted video signal, so as to adjust the luminance in an area where the luminance is less than the lower limit to the lower limit (S411). Each area of the backlight 12 emits light at luminance controlled by the backlight control unit 13, and the liquid crystal panel 11 adjusts the light transmission amount in a portion corresponding to each pixel in the video image according to the video signal. Accordingly, the video display apparatus 100 displays the video image. With this, the video display apparatus 100 completes the process of displaying one frame of video image. The video display apparatus 100 executes the process of steps S401 to S411 every time it displays one frame of video image.

Figure 13:
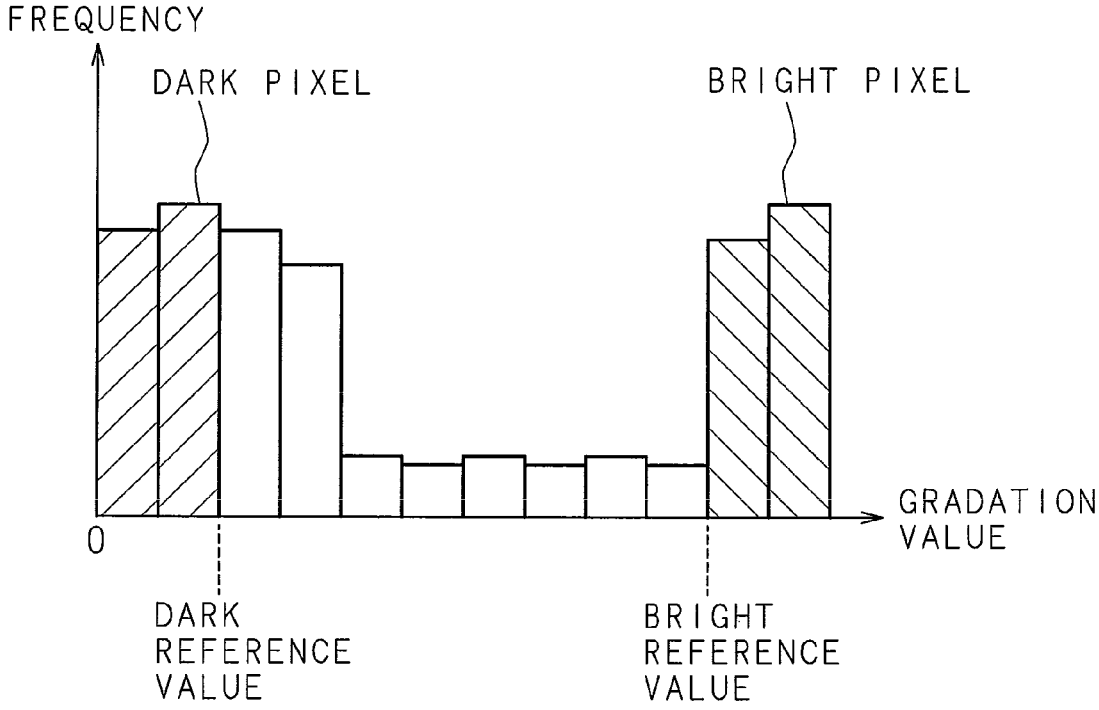
FIG. 13 is a characteristic view showing a histogram of a video image which includes a large number of bright pixels, even though the average value of the gradation values is small.

As described in detail above, in Embodiment 4, the lower limit of luminance in a plurality of areas of the backlight 12 is corrected by multiplying the lower limit of luminance by the first correction coefficient, which becomes smaller with a decrease in the average value of the gradation values, and the second correction coefficient which becomes larger as the bright pixel ratio increases. FIG. 13 is a characteristic view showing a histogram of a video image which includes a large number of bright pixels, even though the average value of the gradation values is small. By correcting the lower limit according to the average value of the gradation values and the bright pixel ratio in the video image, the occurrence of black floating is reduced in a video image which is dark on the whole. Additionally, for a video image which includes some large number of bright pixels even though the average value of the gradation values is small as shown in FIG. 13 and is susceptible to noticeable luminance blur, it is possible to effectively reduce the occurrence of luminance blur by increasing the minimum luminance of the backlight 12. Thus, the quality of the video image displayed by the video display apparatus 100 is improved.

Embodiment 5

In the case where the minimum luminance of the backlight 12 is increased to reduce the occurrence of luminance blur, the contrast ratio of the video image decreases. On the other hand, since the appearance of the video image displayed by the video display apparatus 100 is influenced by environmental light, when a viewer sees the video image in an environment which is bright to some degree, the viewer can hardly perceive a change in the brightness of black. Therefore, even when the contrast ratio decreases, the viewer can hardly perceive the decrease. Thus, under an environment which is bright to some degree, even when the minimum luminance of the backlight 12 is increased, the decrease in the contrast ratio can hardly be perceived. Embodiment 5 illustrates a mode in which the lower limit of luminance determined according to the dark pixel ratio is corrected according to environmental light.

Figure 14:
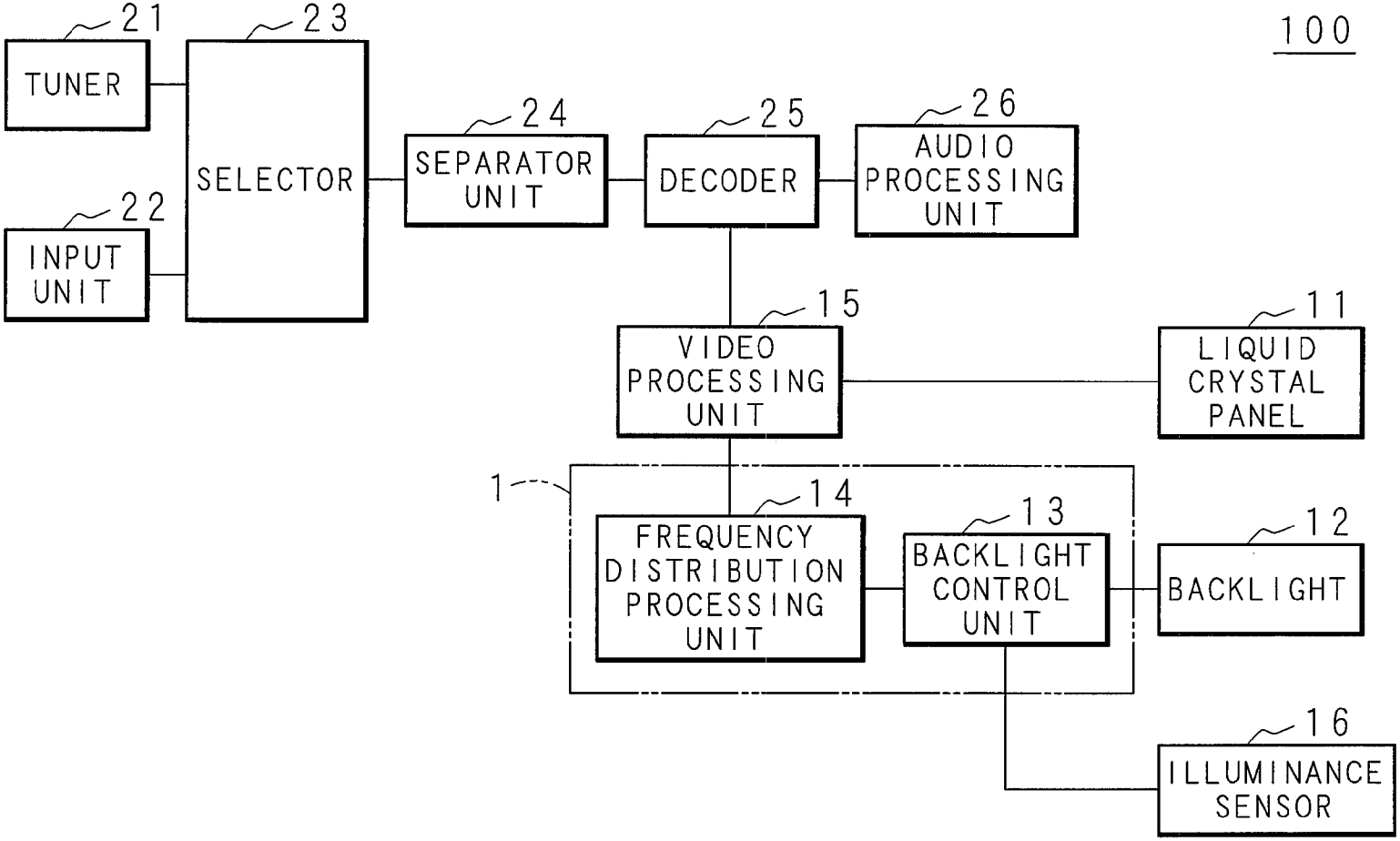
FIG. 14 is a block diagram showing the internal structure of a video display apparatus of Embodiment 5.

FIG. 14 is a block diagram showing the internal structure of the video display apparatus 100 of Embodiment 5. The video display apparatus 100 includes an illuminance sensor 16 for measuring the ambient brightness of the video display apparatus 100, and the illuminance sensor 16 is connected to the backlight control unit 13. The illuminance sensor 16 is placed near the liquid crystal panel 11, and measures the illuminance of external light and outputs the measurement result to the backlight control unit 13. Since the other internal structure of the video display apparatus 100 according to Embodiment 5 is the same as that in Embodiment 1, the explanation thereof will be omitted by designating the corresponding parts with the same codes.

Figure 15:
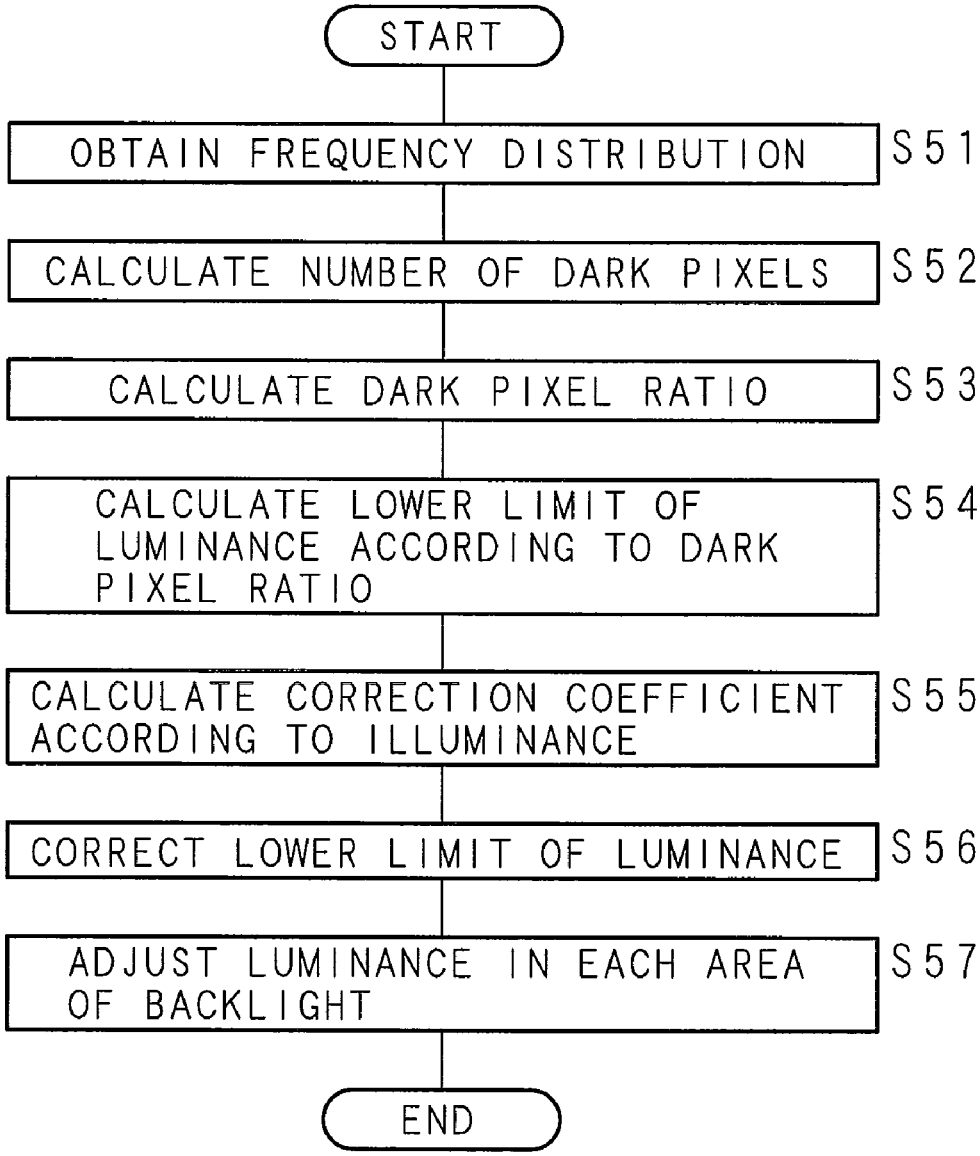
FIG. 15 is a flowchart showing the processing steps carried out by the video display apparatus of Embodiment 5.

FIG. 15 is a flowchart showing the processing steps carried out by the video display apparatus 100 of Embodiment 5. The video processing unit 15 generates a video signal and outputs the video signal to the frequency distribution processing unit 14. The frequency distribution processing unit 14 obtains, from the video signal, the frequency distribution of gradation values of the respective pixels included in one frame of video image based on the video signal (S51). Next, the frequency distribution processing unit 14 calculates the number of dark pixels included in the video image from the obtained frequency distribution (S52), and calculates a dark pixel ratio representing the ratio of the dark pixels included in the video image (S53). After completing step S53, the frequency distribution processing unit 14 outputs the video signal and the calculated dark pixel ratio to the backlight control unit 13. The illuminance sensor 16 outputs the measured illuminance to the backlight control unit 13.

The backlight control unit 13 performs a process of calculating the lower limit of luminance in a plurality of areas included in the backlight 12, according to the dark pixel ratio inputted from the frequency distribution processing unit 14 (S54). Next, the backlight control unit 13 calculates a correction coefficient for correcting the lower limit, according to the illuminance inputted from the illuminance sensor 16 (S55). The backlight control unit 13 stores the relation between the illuminance and the correction coefficient in the form of a function or a numerical table, and calculates a correction coefficient corresponding to the illuminance according to the stored contents in step S55.

Figure 16:
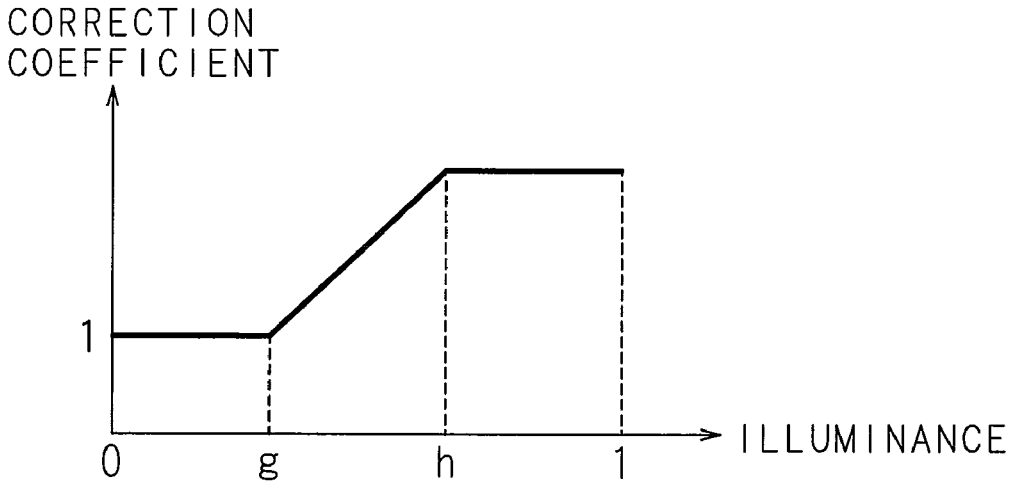
FIG. 16 is a characteristic view showing the relation between the illuminance and the correction coefficient.

FIG. 16 is a characteristic view showing the relation between the illuminance and the correction coefficient. The horizontal axis in FIG. 16 indicates illuminance, while the vertical axis shows the correction coefficient corresponding to illuminance. In a state in which the illuminance is small, the correction coefficient takes a minimum value of 1. The correction coefficient remains at the minimum value of 1 until the illuminance increases to a predetermined threshold value g. The correction coefficient changes linearly until the illuminance increases from the threshold value g and reaches a predetermined threshold value h, so that the higher the illuminance, the higher the correction coefficient. In a state in which the illuminance is at the threshold h, the correction coefficient becomes the maximum value, and the correction coefficient remains at the maximum value in a state in which the illuminance is equal to or greater than the threshold value h. On the whole, the relation between the illuminance and the correction coefficient is such that the correction coefficient increases monotonously according to the illuminance, and that the correction coefficient becomes smaller as the illuminance becomes lower.

Note that the relation between the illuminance and the correction coefficient shown in FIG. 16 is merely one example, and their relation can be different from the one shown in FIG. 16 as long as the correction coefficient increases monotonously with respect to the illuminance. For instance, the relation between the illuminance and the correction coefficient can be represented by a smooth function. In addition, for example, the correction coefficient can take discrete values on the basis of a predetermined illuminance.

Next, with the use of the calculated correction coefficient, the backlight control unit 13 performs a process of correcting the lower limit calculated in step S54 (S56). More specifically, the backlight control unit 13 multiplies the lower limit before correction by the correction coefficient calculated in step S55 in order to calculate a lower limit after correction as shown by the following equation.

$$\text{(lower limit after correction)}=\text{(lower limit before correction)}\times\text{correction coefficient}$$

Next, the backlight control unit 13 performs a process of adjusting the luminance in each area of the backlight 12 according to the gradation values of the respective pixels in the video image represented by the inputted video signal so as to adjust the luminance in an area where the luminance is less than the lower limit to the lower limit (S57). Each area of the backlight 12 emits light at luminance controlled by the backlight control unit 13, and the liquid crystal panel 11 adjusts the light transmission amount in a portion corresponding to each pixel in the video image according to the video signal. Accordingly, the video display apparatus 100 displays the video image. With this, the video display apparatus 100 completes the process of displaying one frame of video image. The video display apparatus 100 executes the process of steps S51 to S57 every time it displays one frame of video image.

As described in detail above, in Embodiment 5, the lower limit of luminance in a plurality of areas of the backlight 12 is corrected by multiplying the lower limit of luminance by the correction coefficient which increases as the illuminance representing ambient brightness increases. Since the correction coefficient increases with an increase in the illuminance, when the video image is displayed under an environment with bright external light, the lower limit increases, and the minimum luminance of the backlight 12 increases, thereby reducing the occurrence of luminance blur. In a state where the minimum luminance of the backlight 12 increases, the contrast ratio in the video image decreases, but the decrease in the contrast ratio can hardly be recognized under a bright ambient environment. Thus, in Embodiment 5, it is possible to effectively reduce the occurrence of luminance blur while making the decrease in the contrast ratio less noticeable. Consequently, the quality of the video image displayed by the video display apparatus 100 is improved.

Embodiment 6

Embodiment 6 illustrates a mode in which the range of an increase in the minimum luminance in a plurality of areas of the backlight 12 is limited according to the video image. Since the internal structure of the video display apparatus 100 according to Embodiment 6 is the same as that in Embodiment 1, the explanation thereof will be omitted.

Figure 17:
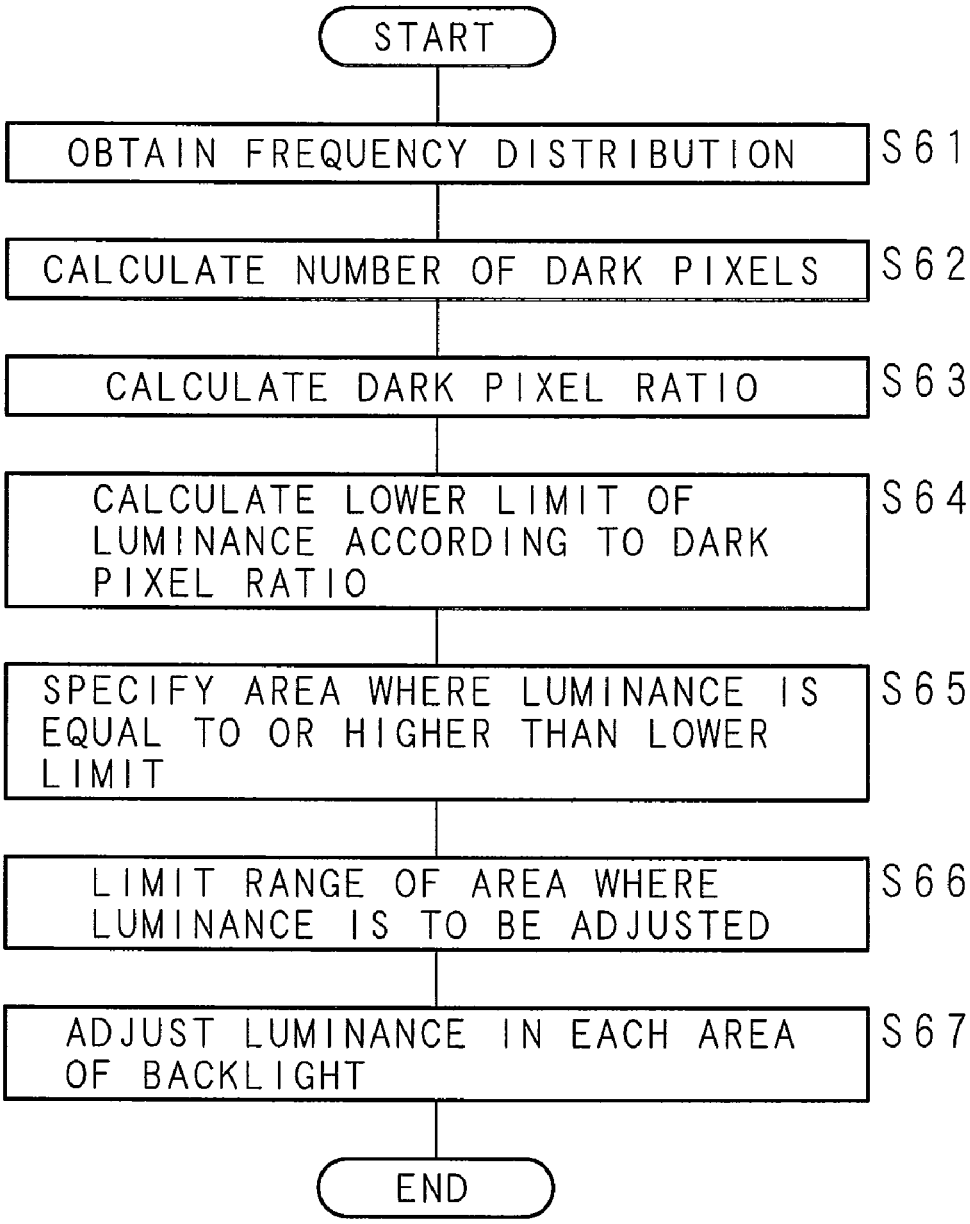
FIG. 17 is a flowchart showing the processing steps carried out by a video display apparatus of Embodiment 6.

FIG. 17 is a flowchart showing the processing steps carried out by the video display apparatus 100 of Embodiment 6. The video processing unit 15 generates a video signal and outputs it to the frequency distribution processing unit 14. The frequency distribution processing unit 14 obtains, from the video signal, the frequency distribution of gradation values of the respective pixels included in one frame of video image based on the video signal (S61). Next, the frequency distribution processing unit 14 calculates, from the obtained frequency distribution, the number of dark pixels included in the video image (S62), and calculates a dark pixel ratio representing the ratio of the dark pixels included in the video image (S63). After completing step S63, the frequency distribution processing unit 14 outputs the video signal and the calculated dark pixel ratio to the backlight control unit 13.

The backlight control unit 13 performs a process of calculating the lower limit of luminance in a plurality of areas included in the backlight 12, according to the dark pixel ratio inputted from the frequency distribution processing unit 14 (S64). Next, the backlight control unit 13 calculates the luminance in each area according to the gradation values of the respective pixels in the video image represented by the video signal, and specifies an area where the calculated value of luminance is equal to or higher than the lower limit from a plurality of areas included in the backlight 12 (S65). Next, the backlight control unit 13 performs a process of limiting the range of areas where luminance less than the lower limit is to be adjusted to the lower limit (S66). More specifically, the backlight control unit 13 sets a range of areas adjacent to the area specified in step S65 as a limited range that is a range of areas where the luminance less than the lower limit is to be adjusted to the lower limit. Note that the areas to be included in the limited range are not limited to areas adjacent to the area specified in step S65, and areas located within a predetermined range from the area specified in step S65 can be included in the limited range.

Next, the backlight control unit 13 performs a process of adjusting the luminance in each area of the backlight 12 according to the gradation values of the respective pixels in the video image represented by the inputted video signal so as to adjust the luminance in areas within the limited range where the luminance is less than the lower limit to the lower limit (S67). In step S67, for an area where the value of luminance calculated in step S65 is equal to or higher than the lower limit, the backlight control unit 13 adjusts the luminance in the area to the calculated luminance. Moreover, for an area included in the limited range set in step S66 among the areas where the value of luminance calculated in step S65 is less than the lower limit, the backlight control unit 13 adjusts the luminance in the area to the lower limit, while for an area which is not included in the limited range, the backlight control unit 13 adjusts the luminance in the area to the calculated luminance.

Each area of the backlight 12 emits light at luminance controlled by the backlight control unit 13, and the liquid crystal panel 11 adjusts the light transmission amount in a portion corresponding to each pixel in the video image, according to the video signal. Accordingly, the video display apparatus 100 displays the video image. With this, the video display apparatus 100 completes the process of displaying one frame of video image. The video display apparatus 100 executes the process of steps S61 to S67 every time it displays one frame of video image.

Figure 18:
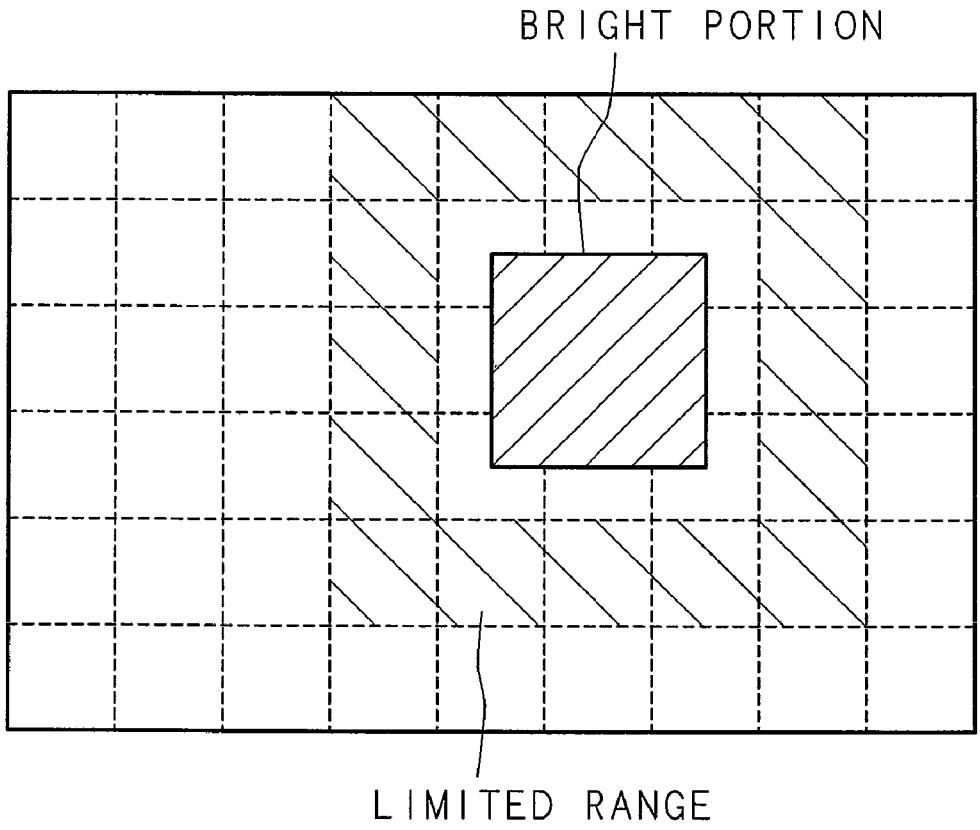
FIG. 18 is a schematic view showing a screen example of the video display apparatus of Embodiment 6.

FIG. 18 is a schematic view showing a screen example of the video display apparatus 100 of Embodiment 6. In FIG. 18, a boundary between the areas of the backlight 12 is indicated by a broken line. Among the areas of the backlight 12, areas adjacent to areas illuminating a bright portion of the video image are included in the limited range. In the limited range, the luminance in an area where the luminance according to the video image is less than the lower limit is adjusted to the lower limit. Outside the limited range, even when the luminance according to the video image becomes less than the lower limit, the luminance in each area remains less than the lower limit. Since the luminance in each area of the backlight 12 within the limited range becomes equal to or greater than the lower limit, the difference in luminance between an area illuminating both a bright portion and a dark portion of the video image and areas adjacent to the area is reduced, thereby reducing the occurrence of luminance blur. Moreover, outside the limited range, the luminance in an area illuminating a dark portion of the video image is less than the lower limit, and thus it is possible to prevent an increase in power consumption.

Embodiments 1 to 6 described above illustrate modes in which the dark pixel ratio and the bright pixel ratio are used as the dark pixel amount and the bright pixel amount according to the present invention, but the present invention is not limited to them. For example, the present invention can be implemented in a mode in which the number of dark pixels is used as the dark pixel amount, or a mode in which the number of bright pixels is used as the bright pixel amount. Further, although Embodiments 1 to 6 illustrate modes in which the processes to be performed by the video display apparatus 100 are executed by hardware devices, the video display apparatus 100 of the present invention can execute a part or all of the processes by software.

Although Embodiments 1 to 6 illustrate modes using the backlight 12 including a plurality of LEDs as a light source, the backlight in the present invention is not limited to this. The backlight in the present invention can be a backlight using other light emitting elements, such as EL (electroluminescence) elements, as a light source as long as it can adjust the luminance in each area individually. In addition, although Embodiments 1 to 6 illustrate modes using the liquid crystal panel 11 as a video display panel according to the present invention, the video display panel of the present invention is not limited to this. The video display panel of the present invention can be other video display panel as long as it is a transmission type video display panel which displays a video image by using light from the backlight.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A backlight luminance control apparatus comprising:

a luminance control unit for individually controlling luminance in each of a plurality of areas constituting a planar backlight, which illuminates a video display panel for displaying a video image based on a video signal, according to gradation values of the video image displayed in an area of said video display panel illuminated by each area;

a frequency distribution obtaining unit for obtaining a frequency distribution of gradation values of pixels constituting a video image, based on a video signal;

a dark pixel amount calculating unit for calculating, from the frequency distribution obtained by said frequency distribution obtaining unit a dark pixel amount indicating an amount of pixels whose gradation values are equal to or less than a predetermined first reference value;

a lower limit calculating unit for calculating a lower limit of luminance in the areas to a value which decreases monotonously according to the dark pixel amount;

an adjusting unit for adjusting the luminance in an area where the luminance according to the gradation values of the video image is less than the lower limit among a plurality of areas of said backlight to the lower limit;

an average calculating unit for calculating an average value of the gradation values from the frequency distribution; and a unit for correcting the lower limit by multiplying the lower limit calculated by said lower limit calculating unit by a coefficient which increases monotonously according to the average value calculated by said average calculating unit.

2. A backlight luminance control apparatus comprising:

a luminance control unit for individually controlling luminance in each of a plurality of areas constituting a planar backlight, which illuminates a video display panel for displaying a video image based on a video signal, according to gradation values of the video image displayed in an area of said video display panel illuminated by each area;

a frequency distribution obtaining unit for obtaining a frequency distribution of gradation values of pixels constituting a video image, based on a video signal;

a dark pixel amount calculating unit for calculating, from the frequency distribution obtained by said frequency distribution obtaining unit a dark pixel amount indicating an amount of pixels whose gradation values are equal to or less than a predetermined first reference value;

a lower limit calculating unit for calculating a lower limit of luminance in the areas to a value which decreases monotonously according to the dark pixel amount;

an adjusting unit for adjusting the luminance in an area where the luminance according to the gradation values of the video image is less than the lower limit among a plurality of areas of said backlight to the lower limit;

a bright pixel amount calculating unit for calculating, from the frequency distribution, a bright pixel amount indicating an amount of pixels whose gradation values are equal to or greater than a predetermined second reference value which is greater than the first reference value; and a unit for correcting the lower limit by multiplying the lower limit calculated by said lower limit calculating unit by a coefficient which increases monotonously according to the bright pixel amount calculated by said bright pixel amount calculating unit.

3. A video display apparatus, comprising:

a video display panel for displaying a video image based on a video signal;

a backlight for illuminating said video display panel by emitting light in a planar manner;

a luminance control unit for individually controlling luminance in each of a plurality of areas constituting said backlight, according to gradation values of the video image displayed in an area of said video display panel illuminated by each area;

a frequency distribution obtaining unit for obtaining a frequency distribution of gradation values of pixels constituting a video image, based on a video signal;

a dark pixel amount calculating unit for calculating, from the frequency distribution obtained by said frequency distribution obtaining unit, a dark pixel amount indicating an amount of pixels whose gradation values are equal to or less than a predetermined first reference value;

a lower limit calculating unit for calculating a lower limit of luminance in the areas to a value which decreases monotonously according to the dark pixel amount;

an adjusting unit for adjusting the luminance in an area where the luminance according to the gradation values of the video image is less than the lower limit among a plurality of areas of said backlight to the lower limit;

an average calculating unit for calculating an average value of the gradation values from the frequency distribution; and a unit for correcting the lower limit by multiplying the lower limit calculated by said lower limit calculating unit by a coefficient which increases monotonously according to the average value calculated by said average calculating unit.

4. The video display apparatus according to claim 3, comprising:

a bright pixel amount calculating unit for calculating, from the frequency distribution, a bright pixel amount indicating an amount of pixels whose gradation values are equal to or greater than a predetermined second reference value which is greater than the first reference value; and a unit for correcting the lower limit by multiplying the lower limit calculated by said lower limit calculating unit by a coefficient which increases monotonously according to the bright pixel amount calculated by said bright pixel amount calculating unit.

5. The video display apparatus according to claim 4, comprising:

a measuring unit for measuring ambient brightness; and a unit for correcting the lower limit by multiplying the lower limit calculated by said lower limit calculating unit by a coefficient which increases monotonously according to the ambient brightness measured by said measuring unit.

6. The video display apparatus according to claim 5, comprising:

a specifying unit for specifying an area where the luminance according to the gradation values of the video image is equal to or greater than the lower limit from a plurality of areas of said backlight; and a limiting unit for limiting an area whose luminance is to be adjusted to the lower limit among areas where the luminance according to the gradation values of the video image is less than the lower limit to areas located within a predetermined distance from the area specified by said specifying unit.

7. The video display apparatus according to claim 4, comprising:

a specifying unit for specifying an area where the luminance according to the gradation values of the video image is equal to or greater than the lower limit from a plurality of areas of said backlight; and a limiting unit for limiting an area whose luminance is to be adjusted to the lower limit among areas where the luminance according to the gradation values of the video image is less than the lower limit to areas located within a predetermined distance from the area specified by said specifying unit.

8. The video display apparatus according to claim 3, comprising:

a measuring unit for measuring ambient brightness; and a unit for correcting the lower limit by multiplying the lower limit calculated by said lower limit calculating unit by a coefficient which increases monotonously according to the ambient brightness measured by said measuring unit.

9. The video display apparatus according to claim 8, comprising:

a specifying unit for specifying an area where the luminance according to the gradation values of the video image is equal to or greater than the lower limit from a plurality of areas of said backlight; and a limiting unit for limiting an area whose luminance is to be adjusted to the lower limit among areas where the luminance according to the gradation values of the video image is less than the lower limit to areas located within a predetermined distance from the area specified by said specifying unit.

10. The video display apparatus according to claim 3, comprising:

a specifying unit for specifying an area where the luminance according to the gradation values of the video image is equal to or greater than the lower limit from a plurality of areas of said backlight; and a limiting unit for limiting an area whose luminance is to be adjusted to the lower limit among areas where the luminance according to the gradation values of the video image is less than the lower limit to areas located within a predetermined distance from the area specified by said specifying unit.

11. A video display apparatus, comprising:

a video display panel for displaying a video image based on a video signal;

a backlight for illuminating said video display panel by emitting light in a planar manner;

a luminance control unit for individually controlling luminance in each of a plurality of areas constituting said backlight, according to gradation values of the video image displayed in an area of said video display panel illuminated by each area;

a frequency distribution obtaining unit for obtaining a frequency distribution of gradation values of pixels constituting a video image, based on a video signal;

a dark pixel amount calculating unit for calculating, from the frequency distribution obtained by said frequency distribution obtaining unit, a dark pixel amount indicating an amount of pixels whose gradation values are equal to or less than a predetermined first reference value;

a lower limit calculating unit for calculating a lower limit of luminance in the areas to a value which decreases monotonously according to the dark pixel amount;

an adjusting unit for adjusting the luminance in an area where the luminance according to the gradation values of the video image is less than the lower limit among a plurality of areas of said backlight to the lower limit;

a bright pixel amount calculating unit for calculating, from the frequency distribution, a bright pixel amount indicating an amount of pixels whose gradation values are equal to or greater than a predetermined second reference value which is greater than the first reference value; and a unit for correcting the lower limit by multiplying the lower limit calculated by said lower limit calculating unit by a coefficient which increases monotonously according to the bright pixel amount calculated by said bright pixel amount calculating unit.

12. The video display apparatus according to claim 11, comprising:

a measuring unit for measuring ambient brightness; and a unit for correcting the lower limit by multiplying the lower limit calculated by said lower limit calculating unit by a coefficient which increases monotonously according to the ambient brightness measured by said measuring unit.

13. The video display apparatus according to claim 12, comprising:

a specifying unit for specifying an area where the luminance according to the gradation values of the video image is equal to or greater than the lower limit from a plurality of areas of said backlight; and a limiting unit for limiting an area whose luminance is to be adjusted to the lower limit among areas where the luminance according to the gradation values of the video image is less than the lower limit to areas located within a predetermined distance from the area specified by said specifying unit.

14. The video display apparatus according to claim 11, comprising:

a specifying unit for specifying an area where the luminance according to the gradation values of the video image is equal to or greater than the lower limit from a plurality of areas of said backlight; and a limiting unit for limiting an area whose luminance is to be adjusted to the lower limit among areas where the luminance according to the gradation values of the video image is less than the lower limit to areas located within a predetermined distance from the area specified by said specifying unit.

* * * * *